United States Patent [19]

Lowe

[11] 4,365,453

[45] Dec. 28, 1982

[54] FRAMELESS METAL BUILDING AND BUILDING COMPONENTS

[76] Inventor: Colin F. Lowe, 5214 Sanford, Houston, Tex. 77035

[21] Appl. No.: 140,764

[22] Filed: Apr. 16, 1980

Related U.S. Application Data

[63] Continuation-in-part of Ser. No. 59,575, Jul. 23, 1979, Pat. No. 4,301,628, which is a continuation-in-part of Ser. No. 969,342, Dec. 14, 1978, which is a continuation-in-part of Ser. No. 931,854, Aug. 7, 1978, Pat. No. 4,221,087, which is a continuation-in-part of Ser. No. 831,781, Sep. 9, 1977, Pat. No. 4,106,245.

[51] Int. Cl.[3] ..... E04B 7/02

[52] U.S. Cl. ..... 52/478; 52/90; 52/94; 52/630

[58] Field of Search ..... 52/18, 90, 86, 630, 52/94, 478

[56] References Cited

U.S. PATENT DOCUMENTS

| | | | |
|---|---|---|---|
| 1,800,363 | 4/1931 | Sisson | 52/45 |
| 2,549,201 | 4/1951 | Hunter | 52/90 X |
| 3,129,791 | 4/1964 | Gumucio et al. | 52/828 X |
| 3,135,070 | 6/1964 | Waring et al. | 52/90 |
| 3,157,251 | 11/1964 | Rasch | 52/93 |
| 3,300,923 | 1/1967 | Behlen | 52/86 X |
| 3,308,596 | 3/1967 | Cooper et al. | 52/630 |
| 3,402,516 | 9/1968 | Kanarr | 52/75 |
| 3,820,295 | 6/1974 | Folley | 52/90 |
| 3,959,942 | 6/1976 | Merson | 52/630 X |
| 3,968,603 | 7/1976 | Merson | 52/630 X |
| 4,106,245 | 8/1978 | Lowe | 52/90 |
| 4,221,087 | 9/1980 | Lowe | 52/90 |

FOREIGN PATENT DOCUMENTS

| | | | |
|---|---|---|---|
| 815202 | 4/1937 | France | 52/588 |
| 69695 | 11/1969 | German Democratic Rep. | 52/86 |
| 1216073 | 12/1970 | United Kingdom | 52/630 |

*Primary Examiner*—Alfred C. Perham
*Attorney, Agent, or Firm*—Jacox & Meckstroth

[57] ABSTRACT

A series of rectangular sheet metal roof and wall panels include generally flat inner and outer corrugated skin portions rigidly connected by corrugated web portions to form parallel spaced primary corrugations. A fabricated sheet metal ridge beam rigidly connects the inner skin portions of the roof panels on opposite sides of the ridge to transmit tension forces, and connects the outer skin portions of the roof panels for transmitting compression forces. Inclined inner eave attachment plates or panels rigidly connect the skin portions of the roof and wall panels, and the inter-fitting web portions of the roof and wall panels are connected to form a building structure which has substantial total strength and may be easily and quickly erected without the use of a crane. Each of the panels in the wall assembly and roof assembly is prepunched and may be formed from a single metal sheet which has a single major corrugation or from a sheet having a Z-shaped lateral configuration. Each panel assembly may also be constructed with independent Z-shape or C-shape web panels connecting separate inner and outer skin panels. Longitudinally spaced sheet metal or molded plastic spacers are disposed in the primary corrugations and connect the outer skin portions and web portions of the assembled panels. Longitudinally spaced and laterally extending elongated stiffeners or tie members rigidly connect the inner skin portions and spacers of the assembled panels, and the panel assemblies may also be used to form only end walls and/or side walls of a building having a partial frame.

16 Claims, 46 Drawing Figures

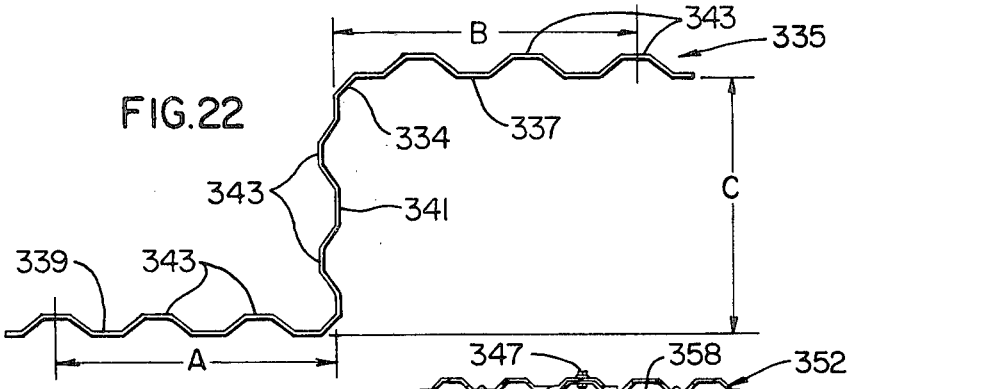
FIG.22
B
343
335
334
337
C
343
341
339
343
A
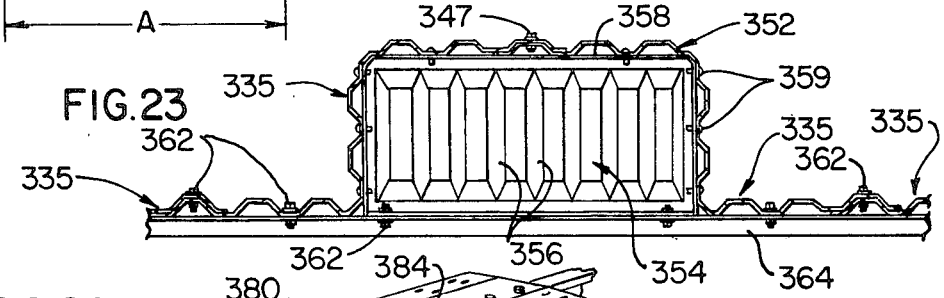
FIG.23
347
358
352
335
359
335
335
362
362
335
362
356
354
364
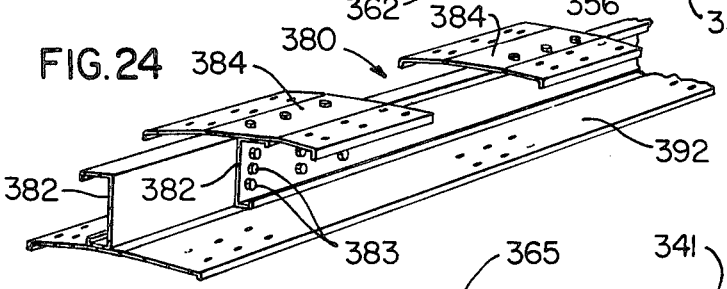
FIG.24
384
380
384
392
382
382
383
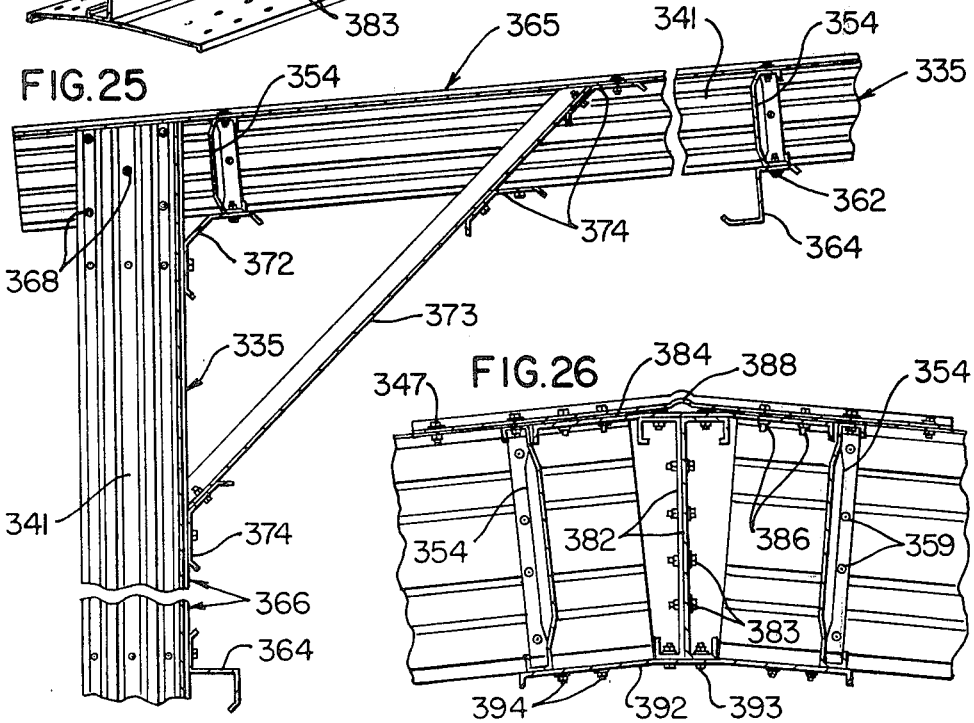
FIG.25
365
341
354
354
335
362
374
364
368
372
373
335
341
374
366
364
FIG.26
384
388
354
347
354
382
386
359
383
394
392
393

FRAMELESS METAL BUILDING AND BUILDING COMPONENTS

RELATED APPLICATION

This application is a continuation-in-part of U.S. application Ser. No. 059,575, filed July 23, 1979, U.S. Pat. No. 4,301,628, which is a continuation-in-part of U.S. application Ser. No. 969,342, filed Dec. 14, 1978 which is a continuation-in-part of U.S. patent application Ser. No. 931,854, filed Aug. 7, 1978 now U.S. Pat. No. 4,221,087, which is a continuation-in-part of U.S. patent application Ser. No. 831,781, filed Sept. 9, 1977, now U.S. Pat. No. 4,106,245.

BACKGROUND OF THE INVENTION

In the art of metal buildings, it is common to use a steel frame which provides for a low roof pitch and for resisting the loads on the building. Parallel spaced roof purlins and parallel spaced wall girts are secured to the frame, and corrugated sheet metal skins or panels are attached to the outer surfaces of the roof purlins and wall girts to form the outer covering or shell for the building. Usually the outer metal skin or sheet metal panels are corrugated in order for the panels to span the spaces between adjacent roof purlins and wall girts, but the frame supports substantially the entire static, wind and snow loads on the metal building.

There have been attempts to construct metal buildings without a metal frame, purlins and girts and to use the inherent strength of corrugated roof and wall panels to withstand the various loads on the building. Examples of such building constructions are disclosed in U.S. Pat. No. 2,742,114 and No. 3,492,765. It has also been proposed to construct a metal building without the use of purlins and girts by erecting a frame and attaching to the frame heavy corrugated sheet metal panels, for example, as disclosed in U.S. Pat. No. 3,308,596. The construction of a metal building has also been proposed from prefabricated roof and wall panels each of which includes inner and outer corrugated sheet metal skins tied together by braces or bars, for example, as disclosed in U.S. Pat. No. 3,064,771 and No. 3,500,596. Corrugated sheet metal panels have also been used or proposed to form a single skin sheet metal building, for example, as disclosed in above mentioned U.S. Pat. No. 3,492,765 and in U.S. Pat. No. 3,156,070, No. 3,568,388, No. 3,657,849, No. 3,820,295, No. 3,959,942 and No. 3,968,603.

SUMMARY OF THE INVENTION

The present invention is directed to an improved sheet metal building structure of prefabricated sheet metal panels constructed and assembled in a manner which provides for substantially high total strength and thus high resistance to wind and snow loads, and which eliminates the need for a metal frame, roof purlins and wall girts. In addition, the metal building of the present invention significantly reduces the total time and cost for constructing and erecting a metal building and, in addition, eliminates the need for a crane to erect the building. The construction of the prefabricated sheet metal panels and the manner by which the panels are coupled together further provides for fast, simple and accurate erection of a metal building and utilizes the inherent strength of the sheet metal inner and outer skins or skin portions of the panels to support or carry substantially the entire loads which are applied to the building as a result of various weather conditions.

Other features and advantages of the invention will be apparent from the following description, the accompanying drawings and the appended claims.

BRIEF DESCRIPTION OF THE DRAWINGS

FIG. 22 is an end view of a modified sheet metal panel constructed in accordance with the invention;

FIG. 23 is a fragmentary section of a panel assembly illustrating the assembly of two of the panels shown in FIG. 22;

FIG. 24 is a fragmentary perspective view of an assembled ridge beam constructed in accordance with a modification of the invention;

FIG. 25 is a fragmentary section similar to FIG. 10 and showing the eave portion of a building constructed with the panels and ridge beam shown in FIGS. 22–24;

FIG. 26 is a fragmentary section similar to FIG. 12 and showing the ridge portion of the building referred to in FIG. 25;

DESCRIPTION OF THE PREFERRED EMBODIMENTS

Figure 1:
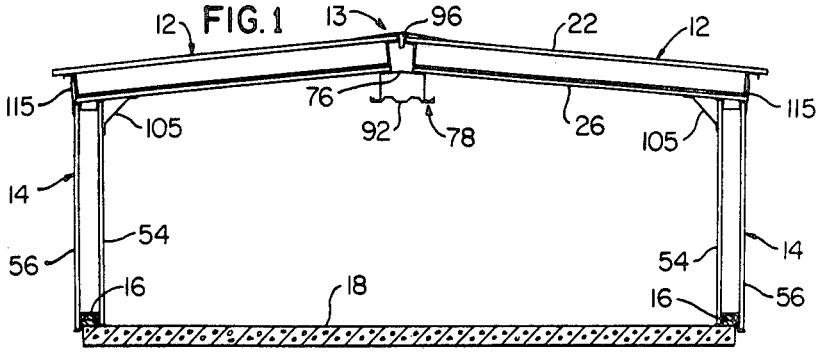
FIG. 1 is an end elevational view of a sheet metal building constructed in accordance with the invention and with the end walls removed.

A metal building constructed in accordance with the invention has an end view as generally illustrated in FIG. 1 and includes a plurality of prefabricated rectangular roof panels 12 which are coupled together along the center ridge 13 of the building and which are coupled together and supported by a plurality of prefabricated rectangular side wall panels 14 and end wall panels (not shown). The vertical side and end wall panels seat upon base floor plates 16 which are bolted to the outer edges of a concrete slab floor 18.

Figure 2:
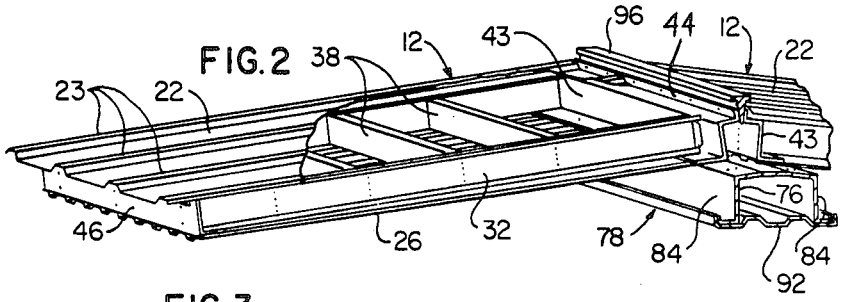
FIG. 2 is a fragmentary perspective view of two opposing roof panels used in the building shown in FIG. 1 and illustrating the system for coupling the roof panels along the ridge of the building.
Figure 7:
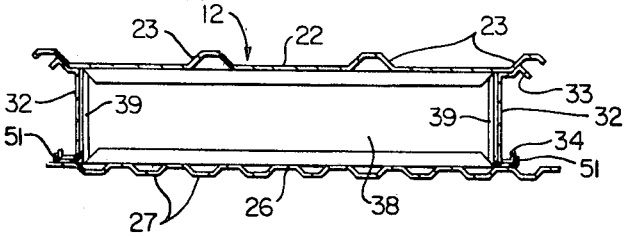
FIG. 7 is an enlarged cross-section of a typical roof panel shown in FIG. 2.

Each of the prefabricated roof panels 12 is constructed of formed sheet metal and includes an upper or outer sheet metal skin 22 (FIGS. 2 and 7) having parallel spaced roll-formed ribs 23. Each roof panel 12 also includes a lower or inner sheet metal skin 26 (FIG. 7) which forms an inner liner for the building and also has parallel spaced ribs 27 to provide a corrugated cross-sectional configuration. As illustrated in FIG. 1, the thicknesses of the roof panels 12 and the wall panels 14 are somewhat exaggerated relative to the size of the metal building.

The roll-formed sheet metal skins 22 and 26 of each roof panel 12 are rigidly secured by blind rivets (not shown) such as "Pop" rivets to parallel spaced longitudinally extending spacer members 32 (FIG. 7) which are formed of sheet metal and have generally a channel-shaped configuration. The upper flange of each spacer member 32 has a V-shaped rib portion 33 which is secured by rivets to an adjacent rib 23 of the overlying outer skin 22, and the lower flange of each spacer member 32 has an inwardly projecting return rib portion 34 and is secured by rivets to the inner sheet metal skin 26.

The longitudinally extending spacer member 32 of each roof panel 12 are rigidly connected by laterally extending spacer members 38 (FIGS. 2 and 7) each of which is also formed of sheet metal and has opposite end flanges 39 (FIG. 7) secured by rivets to the spacer members 32. The upper and lower flanges of each laterally extending spacer member 38 has inwardly projecting rib portions 41. The upper or inner ends of the longitudinally extending spacer members 32 of each roof panel 12 are also rigidly secured by a ridge spacer member 43 (FIG. 4) which has generally a Z-shaped cross-sectional configuration with an upwardly projecting flange 44. The outer or lower ends of the longitudinally extending spacer members 32 of each roof panel 12 are rigidly connected by eave spacer member 46 (FIG. 5) which also has a Z-shaped cross-sectional configuration and includes a downwardly projecting return lip portion 47. All of the spacer members 32, 38, 43 and 46 of each roof panel 12 are formed of sheet metal and are rigidly secured by rivets to the upper or outer skin 22 and lower or inner skin 26 to form, in effect, a box beam. A channel shaped strip 51 (FIGS. 5 and 7) of thermal insulation material is sandwiched between the lower surfaces of each of the spacer members and the inner skin 26 to avoid any significant heat transfer between the inner skin 26 and the outer skin 22.

Figure 3:
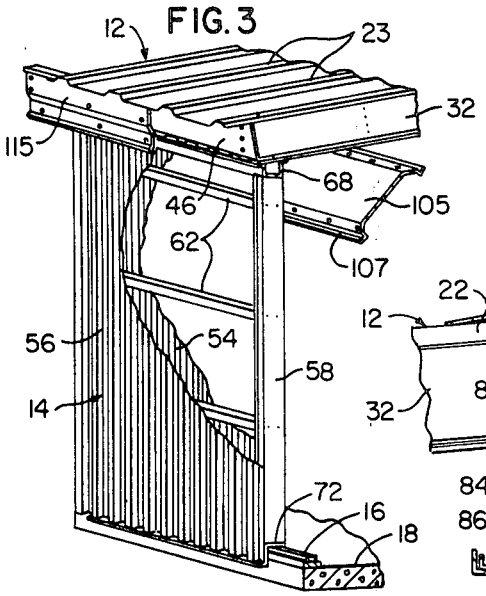
FIG. 3 is a fragmentary perspective view of the wall and roof panels used in the building shown in FIG. 1 and illustrating the coupling of the roof panels to the wall panels.
Figure 8:
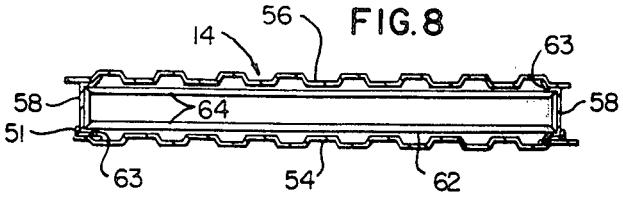
FIG. 8 is an enlarged cross-section of a typical wall panel as shown in FIG. 3.

Each of the side wall panels 14 is constructed or fabricated substantially the same as the roof panels 12. Thus referring to FIGS. 3 and 8, a rectangular wall panel 14 includes a corrugated or ribbed inner sheet metal skin 54 and a ribbed sheet metal outer skin 56 which are secured by rivets to a set of vertical or longitudinally extending sheet metal spacer members 58. The spacer members 58 are rigidly connected by horizontal or laterally extending sheet metal spacer members 62. As shown in FIG. 8, each of the longitudinally extending spacer members 58 has generally a channel-shaped configuration with outwardly projecting lip portions 63 which are riveted to the roll-formed inner and outer skins. Each of the laterally extending spacer members 62 is constructed similar to the spacer members 38 and has inwardly projecting return lip portions 64. The spacer members 62 also have end flanges 66 which are secured by rivets to the parallel spaced longitudinally extending spacer members 58 of the wall panel.

Figure 5:
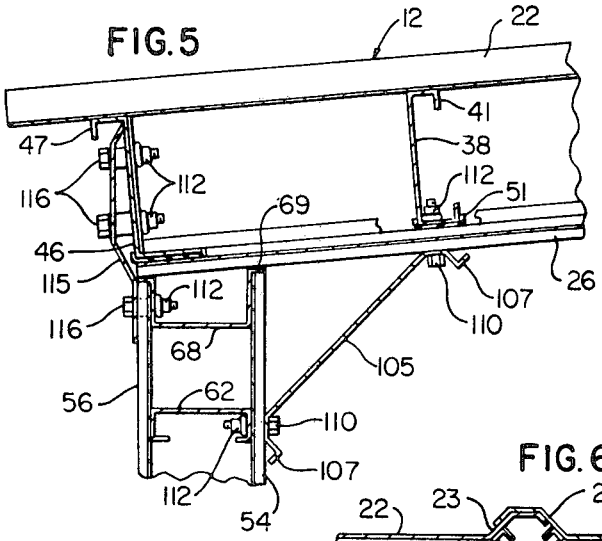
FIG. 5 is an enlarged vertical section through an eve portion of the building shown in FIG. 1.

Referring to FIG. 5, the upper ends of the inner and outer skins of the wall panels 14 forming each side wall are rigidly connected by a channel-shaped horizontal spacer member 68 which has outwardly projecting lip portions 69 overlying the upper ends of the inner and outer skins 54 and 56. The top spacer member 68 is formed in sections and extends continuously the full length of the building and cooperates to align the wall panels. A similarly shaped channel-like spacer member 72 (FIG. 3) rigidly secures the lower end portions of the inner and outer skins of each wall panel 14 and receives the plate member 16 secured to the floor 18. While not shown, the end wall panels for the metal building are constructed substantially the same as the side wall panels 14, except that the end wall panels have a greater length or height and have upper ends which conform to the pitch of the building roof. One or both of the end walls may be provided with a large door opening according to the ultimate use of the metal building.

Figure 6:
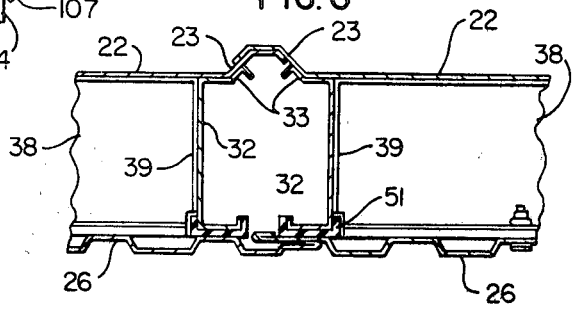
FIG. 6 is an enlarged fragmentary section showing the assembled relation of two adjacent roof panels.

In the erection of a metal building in accordance with the invention, two or more side wall panels 14 are placed upon the floor plate 16 on each side of the building, and the overlapping skins of the wall panels are secured together by fasteners such as screws or blind rivets. The wall panels for one end of the building are also erected and connected to each other and to the adjacent side wall panels 14 at the corners of the building. A set of opposing roof panels 12 are positioned in place, and the inner end portions of the roof panels 12 are rigidly connected by the top plate or ridge member 76 (FIG. 4) of a ridge beam 78. The connection is formed by a set of bolts 81 which are longitudinally spaced along the ridge spacer member 43 and extend through the ridge spacer member and lower roof skin 26 of each roof panel 12 in addition to the ridge beam plate 76. Some of the bolts 81 also extend through the longitudinal spacer members of each roof panel. Thus the bolts 81 and plate 76 form a rigid connection between each set of opposing roof panels 12 along the ridge 13 and provide for transmitting substantial tension forces between the roof panels across the ridge. The next pair of opposing roof panels 12 are assembled, and the skins of adjacent roof panels overlap as shown in FIG. 6. The overlapping ribs of the skins are secured together by fasteners such as screws and/or blind rivets.

The ridge beam 78 also includes downwardly projecting side walls 84 (FIG. 4) and outwardly projecting bottom flanges 86, and is constructed in longitudinal sections which are coupled together as the erection of the building progresses from one end of the building towards the opposite end. The side walls 84 of the ridge beam 78 are also coupled together at longitudinally spaced intervals by rectangular ridge beam spacers 88 which are also formed of sheet metal and are secured to the side walls by rivets. The ridge beam 78 is also connected to opposite end walls of the building, and after the building is erected and the bolts 81 are completely tightened, a bottom sheet metal ridge beam cover 92 is secured to the bottom flanges 86 and cooperates to complete the ridge beam 78 in the form of a box beam.

After all of the roof panels 12 are erected and coupled together by the top plate 76 of the ridge beam 78, and the outer end portions of the roof panels 12 are coupled to the side walls 14, as will be explained later, a tapered wedge member 96 (FIG. 4) is inserted between the upwardly projecting flanges 44 of the ridge spacer members 43 of the roof panels 12, and sections of the wedge member 96 extend continuously the full length of the building. After the wedge member 96 is positioned so that it forms a snug fit between the flanges 44, the wedge member 96 is drilled with holes which align with preformed holes within the flanges 44, and a series of bolts 98 are inserted through the holes to secure the wedge member in place. Thus the wedge member 96 functions to transfer compression forces between the upper or outer skins 22 of opposing sets of roof panels 12 across the ridge 13 and also functions to compensate for accumulated tolerance in the manufacture and assembly of the roof panels. A ridge cover plate 102 is placed over the wedge member 96 and is secured by screws to the outer skins 22 of the roof panels 12.

Referring to FIG. 5, the outer end portion of each roof panel 12 seats upon the upper header and spacer member 68 which connects the upper ends of the side walls panels 14 of each side wall. An inner attachment plate 105 slopes at an angle of approximately 45 degrees between the inner skins of the roof panels 12 and wall panels 14, and the inner attachment plate 105 is formed in longitudinal sections in a manner similar to the ridge beam 78 and wedge member 96. V-shaped ribs 107 are formed along opposite edge portions of each attachment plate 105 for purpose of reinforcement, and the attachment plates may be ribbed or corrugated at longitudinally spaced intervals to provide additional compression strength.

The upper edge portion of each attachment plate 105 is rigidly secured to the roof panels 12 by a series of longitudinally spaced screws 110 each of which is threaded into a preassembled nut 112, preferably in the form of a "Rivnut" manufactured and marketed by The B. F. Goodrich Company. Each "Rivnut" extends through the inner skin 26 and a laterally extending spacer member 38 and secures these components together. Some of the "Rivnuts" also extend through the longitudinally extending spacer members 32 of the roof panels.

The lower edge portion of each inner attachment plate 105 is also rigidly connected to the side wall panels 14 by another set of screws 110. Each screw is threaded into an aligned "Rivnut" 112 which connects the overlapping portions of the longitudinally extending or vertical spacer members 58 and the uppermost laterally extending or horizontal spacer member 62 of each wall panel.

As also shown in FIG. 5, a laterally extending outer attachment plate 115 couples the outer end portions of the roof panels 12 to the upper end portions of the side wall panels 14, and is also formed in longitudinally continuous sections. The upper portion of each section of the outer attachment plate 115 is connected by bolts 116 to "Rivnuts" 112 secured to the overlapping portions of the eave spacer member 46 and end flanges of the longitudinal spacer members 32 of each roof panel 12. The lower portion of each section of the outer attachment plate 115 is secured by bolts 116 which are threaded into "Rivnuts" 112 secured to overlapping portions of the spacer members 58 and 68 of each wall panel 14 and to the outer skin 56.

Figure 9:
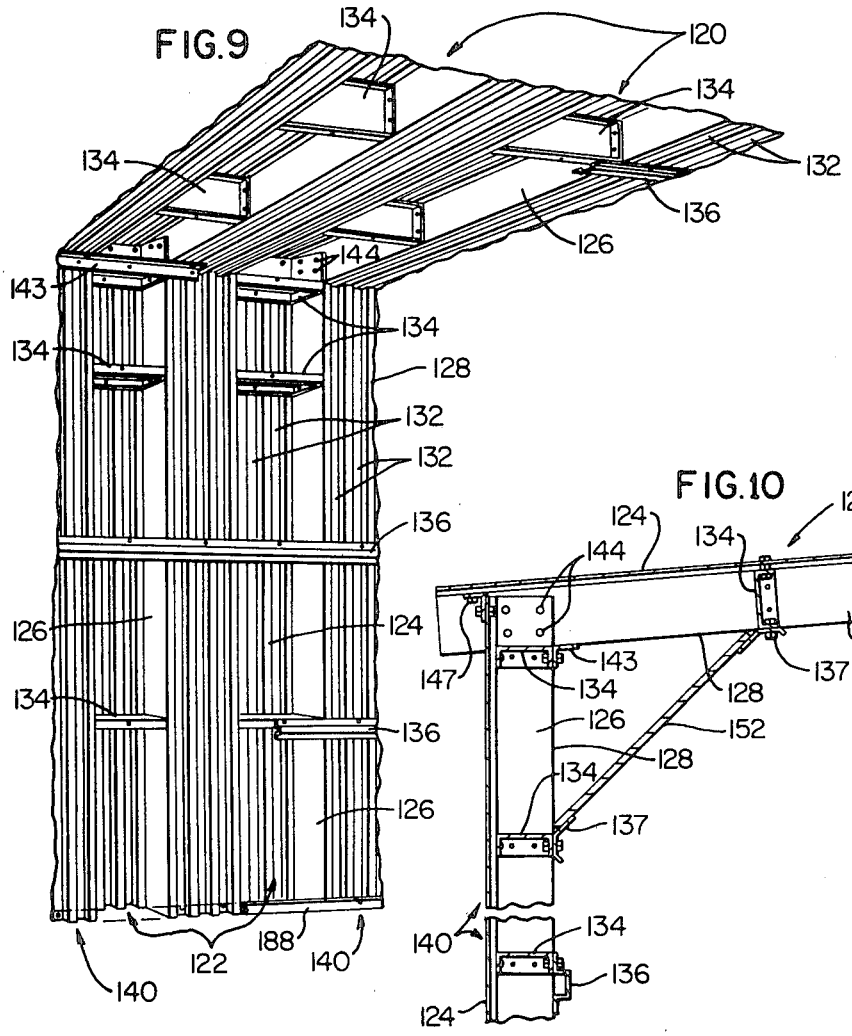
FIG. 9 is an inside perspective view of a portion of a single skin sheet metal building constructed in accordance with another embodiment of the invention.
Figure 10:
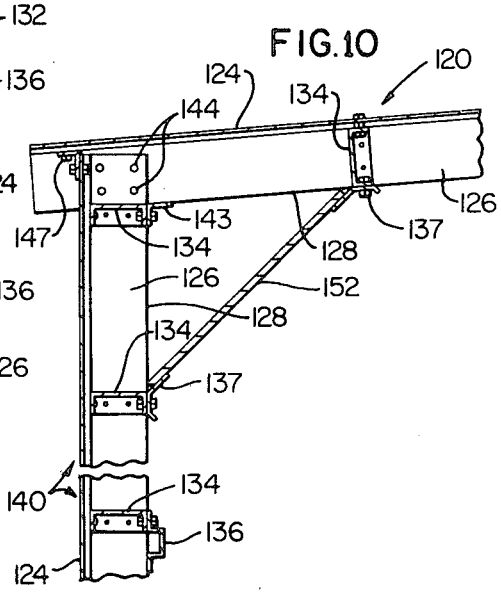
FIG. 10 is a fragmentary vertical section similar to FIG. 5, of the eve portion of the building embodiment shown in FIG. 9.
Figure 11:
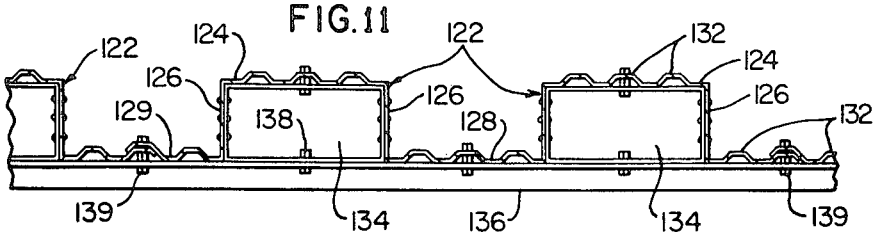
FIG. 11 is a fragmentary lateral section through the assembly of adjacent wall or roof panels used in the building embodiment of FIG. 9.

Referring to FIGS. 9–12, a frameless metal building is constructed in accordance with the invention using a plurality or series of assembled roof panels and wall panels each of which is basically formed from a single metal sheet, with the roof and wall panels having substantially the same construction. Thus as shown in FIGS. 9–11, a plurality of roof panels 120 are each constructed by roll forming a metal sheet to produce parallel spaced and longitudinally extending primary corrugations 122 (FIG. 11). Each primary corrugation 122 is formed by an outer skin portion 124 which integrally connects parallel spaced side wall portions 126. Each of the roof panels 120 also includes inner skin portions 128 and 129 which either connect or extend from the side wall portions 126. Each of the outer skin portions 124 and each of the inner skin portions 128 and 129 includes a plurality of longitudinally extending secondary corrugations 132 which project outwardly of the building in the same direction as the primary corrugations 122, but are substantially smaller than the primary corrugations.

The side wall portions 126 of each primary corrugation 122 are rigidly connected by a plurality of longitudinally spaced spacer members 134. Each spacer member 134 is formed from sheet metal and has peripherally extending border flanges which are secured or fastened to the side wall portions 126 and to the outer skin portion 124 of the corresponding primary corrugation 122. After the roof panels 120 are assembled as illustrated in FIG. 9, the inner skin portions 128 and 129 of the roof panels are rigidly connected to a series of longitudinally spaced and laterally extending tie members 136 (FIG. 11) and 137 (FIG. 10). As illustrated, the tie members 136 and 137 are formed of sheet metal and are secured to the spacer members 134 by fasteners 138 and to the inner skin portions 128 and 129 by fasteners 139.

In the metal building embodiment illustrated in FIGS. 9–14, the assembled roof panels 120 are supported by side wall panels 140 which are constructed substantially the same as the roof panels 120. Accordingly, the reference numbers used above for the components of the roof panels are also used to identify the same components of the wall panels. Referring to FIG. 10, the assembled side wall panels 140 have upper end portions which are notched so that the primary corrugations 122 of each wall panel 140 projects upwardly into the corresponding primary corrugations 122 of the overlying roof panels 120. The roof panels 120 and side wall panels 140 are rigidly connected along the eave portions of the building by an inner elongated tie member 143 which extends longitudinally of the building, with fasteners 144 connecting the adjacent side wall portions 126 of the interfitting roof panels 120 and side wall panels 140.

The outer skin portions 124 of the roof panels 120 and side wall panels 140 are also rigidly connected within each primary corrugation 122 of the panels by an angular shaped outer tie member 147 (FIG. 10) and corresponding fasteners. As also illustrated in FIG. 10, the assembled roof panels 120 are rigidly connected to the assembled side wall panels 140 of each side wall by an inclined corrugated sheet metal brace member or panel 152 which extends the length of the building along the eave portion. Each brace panel 152 is rigidly connected to the laterally extending tie members 137 within the roof panels 120 and within the side wall panels 140.

Figure 12:
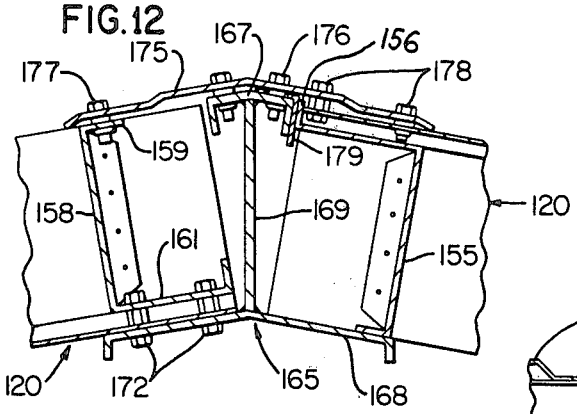
FIG. 12 is a fragmentary vertical section, similar to FIG. 4, through the ridge portion of the building embodiment shown in FIG. 9.

Referring to FIG. 12, a formed generally L-shaped metal spacer member 155 extends laterally within each primary corrugation 122 of each roof panel 120 and includes an upper flange portion 156 which abuts the upper or inner end of the adjacent outer skin portion 124 of the corrugation. A similarly formed metal spacer member 158 extends externally between the side wall portions 126 of each pair of adjacent primary corrugations 122 of the roof panels 120 and includes an upper flange portion 159 and a lower flange portion 161. All of the spacer members 155 and 158 are rigidly secured by fasteners to the adjacent side wall portions 126 of the roof panels 120.

A ridge beam 165 (FIG. 12) extends the length of the building and includes an upper flange portion 167 and a lower flange portion 168 rigidly connected by a vertical web portion 169. The inner end portions of the roof panels 120 seat on the bottom flange portion 168 of the ridge beam 165, and fasteners 172 connect the bottom flange portion 168 of the ridge beam to the inner skin portions 128 and 129 of the roof panels and to the bottom flange portions 161 of the spacer members 158. A ridge cover member or plate 175 overlies the inner end portions of the assembled roof panels 120 and extends the length of the building. The ridge plate is connected by fasteners 176 to the upper flange 167 of the ridge beam 165 and is also connected by fasteners 177 to the upper flange portion 159 of the spacer members 158 which are located in an alternating manner on opposite sides of the ridge beam 165. Another set of fasteners 178 also connect the ridge plate member 175 to the outer skin portions 124 of the roof panels 120.

A filler or spacer strip 179 extends between the upper flange portion 156 of each spacer member 155 and the opposing upper flange portion 167 of the ridge beam 165. Thus the upper flange portion 167 of the ridge beam 165 and the ridge plate 175 cooperate with the fasteners to transmit compression forces across the upper part of the ridge portion and between the roof panels 120 located on opposite sides of the ridge beam 165. The lower flange portion 168 of the ridge beam 165 and the fasteners 172 connected to the inner skin portions 128 and 129 and spacer members 134 of the roof panels function to transmit tension forces across the lower part of the ridge and between the lower or inner skin portions of the roof panels 120.

Figure 13:
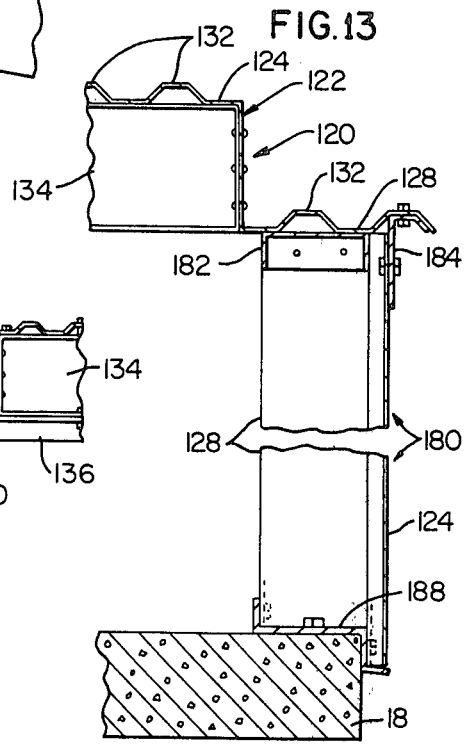
FIG. 13 is a fragmentary vertical section through the assembly of a roof panel and an end wall panel of the building embodiment shown in FIG. 9.

FIG. 13 illustrates the connection of a typical roof panel 120 to a typical end wall panel 180 which is constructed substantially the same as a side wall panel 140 except that the upper end surface of each end wall panel 180 is inclined to mate with the slope or pitch of the roof panels 120. Preferably, this pitch of the roof panels 120 is less than 17 degrees, for example, on the order of 10 degrees. Since the end wall panels 180 are constructed substantially the same as the roof panels described above, the same reference numbers are used for common components.

Figure 14:
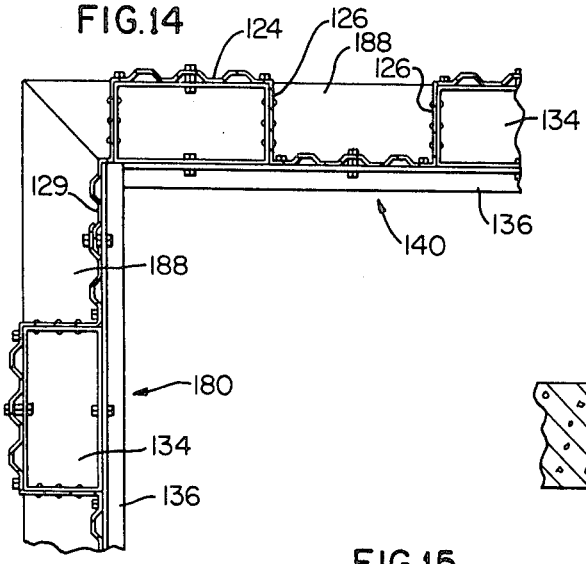
FIG. 14 is a fragmentary horizontal section through the wall panels forming a corner of the building embodiment shown in FIG. 9.

A series of channel-shaped spacer members 182 extend between the side wall portions 126 of each primary corrugation 122 of each end wall panel 180, and an external angle strip or plate 184 connects the outer skin portions 124 of each end wall panel 180 to the inner skin portion 129 of the overlying roof panel 120. As shown in FIGS. 9 and 13, the bottoms of the side wall panels 140 and the end wall panels 180 seat on corresponding formed metal base plates 188 which are secured to the upper surface of the supporting foundation or concrete floor 18. A typical corner connection of an end wall panel 180 and a side wall panel 140 is illustrated in FIG. 14. At each corner, an inner skin portion 129 of the corner side wall panel 140 is formed at right angles around the corner and connects with the inner skin portion 129 of an end wall panel 180.

Figure 15:
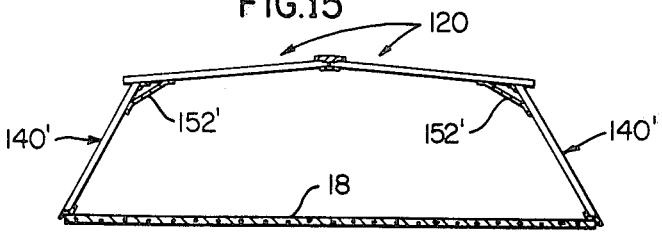
FIG. 15 is a vertical section similar to FIG. 1, through a modified single skin metal building constructed in accordance with the invention and with the end walls removed.

The "single skin" panel building described above in connection with FIGS. 9–14 is shown with assembled vertical side wall panels 140 and assembled vertical end wall panels 180. However, in reference to FIG. 15, it is within the scope of the invention to incline the assembled wall panels, for example, to incline the side wall panels 140' so that the opposite side walls converge towards the top or roof of the building. This results in the use of shorter rectangular roof panels 120' and wider brace panels 152'. Such a building configuration with inclined or tapering side wall is particularly suited for use in storing grains. The side and end wall panels may also be provided with separate sheet metal inner skins which extend at least partially up the walls to prevent the grain from filling the channels defined by the primary corrugations 122.

Figure 16:
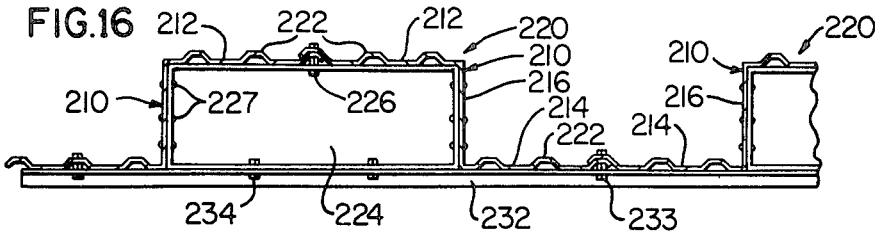
FIG. 16 is a fragmentary section similar to FIG. 11 and showing a modified panel constructed and assembled in accordance with the invention to form a single skin metal building or panel assembly.

FIG. 16 shows another panel assembly which is constructed in accordance with the invention and which may be used for the roof assembly and/or wall assembly of a "single skin" frameless metal building as described above in connection with FIGS. 9–14. The panel assembly shown in FIG. 16 includes a series of Z-shaped panels 210 each of which is roll-formed from an elongated metal sheet to form an outer skin portion 212 and an inner skin portion 214 integrally connected by a side wall or web portion 216. The web portion 216 of each panel 210 forms a right angle or is perpendicular to each of the skin portions 212 and 214 to provide the panel with generally a Z-shape lateral cross-sectional configuration.

The panels 210 are successively assembled at the building site by inverting alternate panels end-for-end so that the panels 210 cooperate to form parallel spaced and longitudinally extending primary corrugations 220. Each primary corrugation 220 is formed by the overlapping outer skin portions 212 of each pair of adjacent panels 210, and the web portions 216 of the adjacent panels 210 form the side walls of the primary corrugation. As also shown in FIG. 16, the outer skin portion 212 and the inner skin portion 214 of each Z-shaped panel 210 includes a series of parallel spaced and longitudinally extending secondary corrugations 222 which project outwardly with respect to the building.

In a manner as described above in connection with FIG. 11, a plurality of spacer members or panels 224 are positioned within each primary corrugation 220 at longitudinally spaced intervals, and each spacer panel is secured to the overlapping outer skin portions 212 of the adjacent panels 210 by fasteners 226, and fasteners 227 secure the spacer panel to the web portions 216 forming the side walls of the corrugation 220. The assembled panels 210 are also secured together after assembly by a series of longitudinally spaced and laterally extending tie members 232 which are secured to the inner skin portions 214 of the panels 210 by fasteners 233 and to the spacer panels 224 by fasteners 234.

Figure 17:
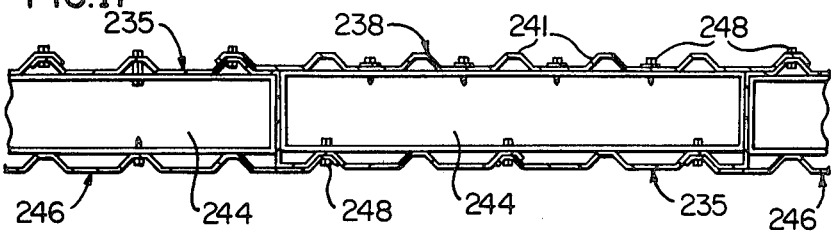
FIG. 17 is a fragmentary section similar to FIG. 16 and showing a modification which forms a double skin metal building or panel assembly.

Referring to FIG. 17, a "double skin" roof and/or wall panel assembly is constructed by successively assembling a series of Z-shaped panels 235 which are constructed substantially the same as the panels 210 described above in connection with FIG. 16. The primary corrugations formed by the panels 235 are then connected by series of generally flat sheet metal outer skin panels 238 which span the gaps between the primary corrugations. Each of the panels 238 has longitudinally extending secondary corrugations 241 which match the secondary corrugations on the outer skin portions of the panels 235 and provide the outer generally flat surface of the building with a uniform appearance.

A series of longitudinally spaced spacer members or panels 244 extend between each outer skin panel 238 and the inner skin portions of each pair of adjacent panels 235, and a series of longitudinally spaced spacer panels 244 are inserted within each of the primary corrugations formed by the assembled panels 235, in the same manner as the spacer panels 224 described above in reference to FIG. 16. In place of the laterally extending tie members 232, the primary corrugation formed by each pair of assembled panels 235 is closed by a sheet metal inner skin panel 246 which is roll formed in the same manner as each outer skin panel 238 and spans the gap formed by the primary corrugation. A series of fasteners 248 secure the panels 235, 238 and 246 to the spacer members or panels 244 so that the Z-shaped panels 235 cooperate with the generally flat panels 238 and 246 to form a "double skin" panel assembly which may be used in place of the "double skin" panel assemblies described above in connection with the embodiment shown in FIGS. 1–8.

Figure 18:
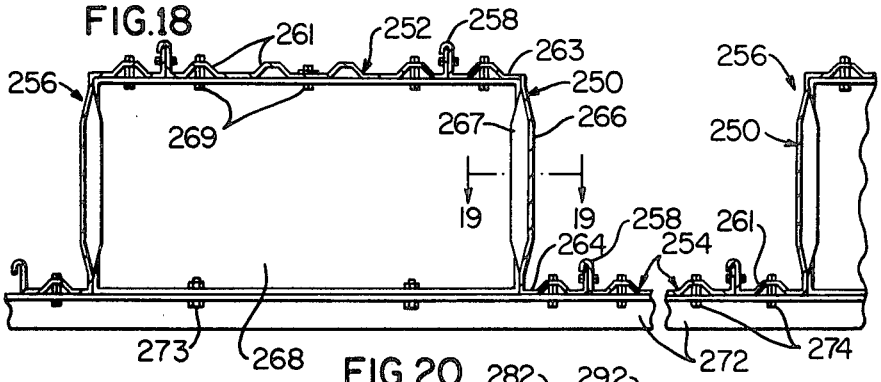
FIG. 18 is a fragmentary section similar to FIG. 16 and showing another single skin embodiment.

Referring to FIG. 18 which shows another form of "single skin" panel assembly constructed in accordance with the invention, a series of Z-shaped sheet metal panels 250 are assembled in the field in opposing relation and are interconnected by generally flat outer skin panels 252 and inner skin panels 254 to form parallel spaced primary corrugations 256. The edge portions of the panels 250, 252 and 254 are connected by "standing seam" joints 258 in place of the joints of overlapping corrugations as shown in FIGS. 16 and 17. All of the panels 250, 252 and 254 are roll formed of sheet metal and include longitudinally extending secondary corrugations 261, and the Z-shaped panels 250 include an outer skin portion 263 and an inner skin portion 264 having a single secondary corrugation 261.

Figure 19:
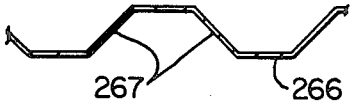
FIG. 19 is a fragmentary section taken generally on the line 19—19 of FIG. 18.

The inner and outer skin portions of each Z-shaped panel 250 are integrally connected by a web portion 266 which is embossed to form laterally extending and longitudinally spaced corrugations 267 as shown in FIG. 19. A series of tray-like spacer members or panels 268 are positioned within each of the primary corrugations 256 at longitudinally spaced intervals and are secured to the outer skin panel 252 and web portions 266 of the panels 250 by fasteners 269. A series of longitudinally spaced and laterally extending tie members 272 are connected to the spacer members 268 by fasteners 273 and to the inner skin panels 254 by fasteners 274, in the same manner as described above in connection with FIG. 16.

Figure 20:
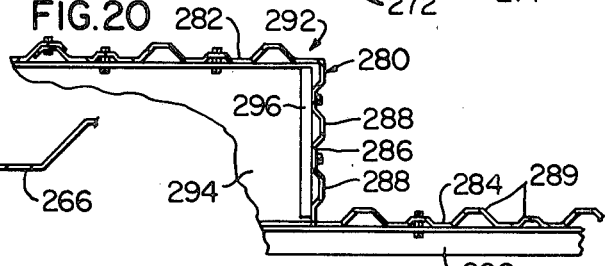
FIG. 20 is a fragmentary section similar to FIG. 18 and showing a further modification of a panel assembly for a single skin panel assembly.

Referring to FIG. 20, a "single skin" panel assembly is constructed of overlapping Z-shaped panels 280 which are roll-formed in a manner similar to that mentioned above in connection with FIG. 16 in that each panel 280 includes an outer skin portion 282 integrally connected to an inner skin portion 284 by a perpendicular wall or web portion 286. In addition, the web portion 286 of each Z-shaped panel 280 includes a series of longitudinally extending secondary corrugations 288 which are roll-formed into the panel along with the outwardly projecting secondary corrugations 289 within the inner and outer skin portions. The assembled panels 280 form the parallel spaced longitudinally extending primary corrugations 292 each of which receives a series of longitudinally spaced spacer members or panels 294. Each of the spacer panels 294 is constructed substantially the same as the spacer panels 224 (FIG. 16) except that each of the panels 294 includes a return lip portion 296. The lip portion 296 increases the strength of the corresponding flange portion of the spacer panel 294 and thereby increases the strength of the web portion 286 of the panel 280. The panels 280 are also rigidly connected by laterally extending tie members 298 in the same manner as the panels 210 are connected by the tie members 232.

Figure 21:
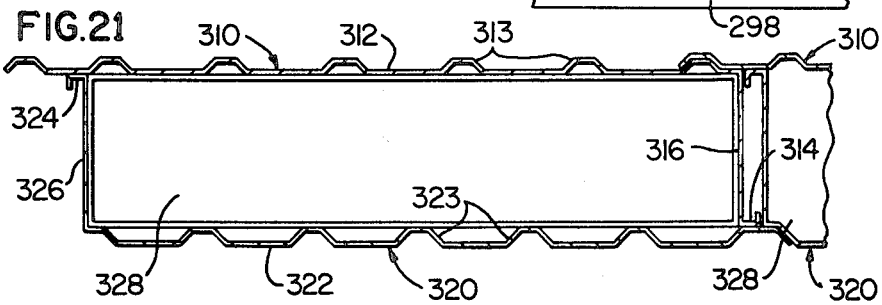
FIG. 21 is a fragmentary section similar to FIG. 17 and showing another modified panel assembly for forming a double skin panel assembly.

Another embodiment of a "double skin" panel assembly is illustrated in FIG. 21. In this embodiment, a roll-formed sheet metal panel 310 includes an outer skin portion 312 having secondary corrugations 313 and integrally connected to an inner skin or flange portion 314 by a web portion 316. Each panel 310 mates with a similarly roll-formed sheet metal panel 320 which includes an inner skin portion 322 having outwardly projecting minor corrugations 323 and integrally connected to an outer skin or flange portion 324 by a web portion 326. Before the panels 210 and 320 are secured together as shown in FIG. 21, a series of longitudinally spaced spacer members or panels 328 are positioned between the panels 310 and 320 and are secured by suitable fasteners (not shown). The spacer members 328 may be installed at the building site when the panels 310 and 320 are progressively assembled or the spacer panels 328 may be preassembled between the panels 310 and 320 when each pair of mating panels 310 and 320 is preassembled at the factory with or without insulation therebetween.

FIG. 22 illustrates a generally Z-shaped panel 335 which is constructed similar to the panel 280 shown in FIG. 20. The panel 335 is formed from a thin gauge sheet metal, or steel, preferably 26 gauge, and includes an outer skin portion 337 integrally connected to an inner skin portion 339 by a side wall or web portion 341. Preferably, the outer skin portion 337 and the inner skin portion 339 each includes three parallel spaced and longitudinally extending secondary corrugations 343, and the web portion 341 includes two secondary corrugations 343. The inner and outer skin portions are integrally connected to the web portion 341 by beveled corner portions 344. The Z-shaped configuration enables a series of panels 335 to be stacked in close nesting relation.

As in the embodiments described above, preferably each panel 335 is prepunched with holes to provide for conveniently and progressively assembling a series of the panels 335 into a frameless metal building. A series of threaded fasteners 347 (FIG. 23) connect overlapping outer skin portions 337 of each pair of adjacent panels, one of which is flipped end-for-end. Another series of fasteners 362 connect the overlapping inner skin portions 339 of each pair of adjacent panels. As shown in FIG. 23, the outer skin portions 337 of each two adjacent assembled panels 335 cooperate with the web portions 341 to form a major or primary corrugation 352 having a depth or height C which is preferably equal to at least one-half of the width B of the outer skin portion.

A series of spacer members or thin sheet metal panels 354 are positioned at longitudinally spaced intervals within each of the primary corrugations 352, and each of the spacer panels 354 has parallel spaced ribs or corrugations 356 which provide the panel with a corrugated cross-sectional configuration. Each spacer panel 354 also has a peripherally extending skirt or flange portion 358 which is secured by fasteners 359 to the outer skin portions 337 and web portions 341 of the two assembled panels 335 forming the primary corrugation 352.

In a manner as mentioned above, as a wall or roof section is being constructed by progressively assembling the panels 335 and spacer members 354, the inner skin portions 339 of the assembled panels are connected by fasteners 362 to continuous tie members 364 which extend the entire length of the building and are located at longitudinally spaced intervals along the length of the panels 335. Each of the stiffeners or tie members 364 has a Z-shaped cross-sectional configuration, as shown in FIG. 25, and is also attached to the aligned spacer member 354 within each primary corrugation 352 by additional threaded fasteners 362. The tie members 364 also serve to support inner liner panels of rigid insulation if it is desired to insulate the building.

Referring to FIG. 22, the inner skin portion 339 of each panel 335 has an attachment width A which is slightly less than the attachment width B of the outer skin portion 337. For example, the difference in widths may be on the order of 3/32 inch. As a result, the overall inner width of each primary corrugation 352 is slightly greater than the combined outer width of assembled inner skin portions 339. Thus an assembly of the panels 335 which form a roof panel assembly 365, will conveniently interfit with an assembly of the panels 335 which form a wall panel assembly 366 when the primary corrugations 352 of the roof assembly are out-of-phase with the primary corrugations 352 of the wall assembly. By simply notching the upper end of the outer skin portions 337 of the panels 335 forming the wall panel assembly 366, the primary corrugations 352 of the roof panel assembly 365 will receive the upper end portions of the wall panels (FIG. 25) where the abutting web portions 341 of the interfitting panels are rigidly secured together by a set of threaded fasteners 368.

The roof panels and wall panels are also coupled together at the eave by an inner sheet metal eave connecting member 372 which is secured by threaded fasteners to adjacent spacer panels 354 within the roof and wall panel assemblies. As also shown in FIG. 25, the roof panel assembly 365 is further connected to the wall panel assembly 366 by diagonal brace panels 373 each of which is formed of sheet metal having minor corrugations and as a width substantially the same as the width of a primary corrugation 352.

Thus the upper end portions of alternate brace panels 373 project upwardly into the major corrugations 352 of the roof panel assembly 365 and are secured by brackets 374 and fasteners to the outer skin panels 337 of the roof panels. The lower end portions of another set of alternating brace panels 373 project into the major corrugations 352 of the wall panel assembly 366 and are secured by brackets 374 and fasteners to the outer skin portions 337 of the wall panels.

Referring to FIGS. 24 and 26, the roof panel assemblies 365 slope upwardly from the side wall panel assemblies 366 forming the opposite side walls of the building and form a peaked ridge where the roof panel assemblies are coupled together by a ridge beam 380 extending the entire length of the metal building. The ridge beam 380 includes a series of C-shaped channel sections 382 which have overlapping end portions secured together by fasteners 383. For example, each beam section 382 may have a length of twelve feet or sixteen feet, and a set of longitudinally spaced connector plates 384 are secured to the upper flange of each beam section 382.

As illustrated in FIG. 26, each connecting plate 384 projects into the primary corrugation 352 of the assembled roof panels on opposite sides of the ridge and is coupled to the outer skin portions 337 by a set of blind-type fasteners 386. The plates 384 and fasteners 386 thus form a connection between the outer skin portions 337 for transferring normal compressive forces therebetween. A sheet metal cover plate 388 overlies the opposing end portions of the roof panel assemblies and forms a weathertight seal.

The ridge beam 380 also includes a bottom beam member or plate 392 (FIG. 26) which is secured by fasteners 393 to the lower flange portions of the channel sections 382. A set of fasteners 394 connect the plate 392 to the inner skin portions 339 of the opposing roof panel assemblies so that the plate 392 and fasteners 394 function to transfer normal tension forces between the roof panel assemblies across the ridge. It is apparent from the above description in reference to FIGS. 22–26 that the panels 335 are assembled to form not only the opposite side walls and roof sections of a frameless metal building, but are also assembled to form the end walls for the building. The particular configuration and assembly of the panels 335 provide the building with substantial strength so that the roof will carry substantial snow loads, and the building will withstand substantial wind loads.

Figure 27:
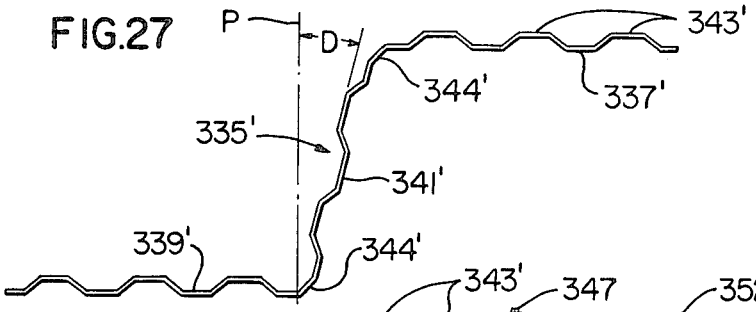
FIG. 27 is an end view of a modified panel similar to the panel shown in FIG. 22.
Figure 28:
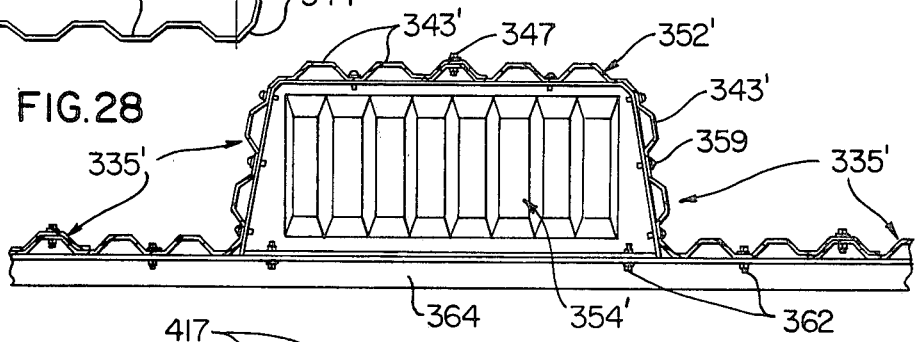
FIG. 28 is a section of a panel assembly similar to FIG. 23 and illustrating the assembly of two panels shown in FIG. 27.

Referring to FIGS. 27 and 28, a Z-shaped panel 335′ is constructed and assembled substantially the same as the panel 335 except that each panel 335′ has a web portion 341′ which is positioned to form an angle D of about ten degrees with a reference plane P perpendicular to the outer skin portion 337′ and inner skin portion 339′ of the panel. An assembly of two panels 335′ (FIG. 28) forms a primary corrugation 352′, and the spacer members or panels 354′ conforms to the taper of the panel web portions 341′. Otherwise the assembly shown in FIG. 28 is identical to the assembly shown in FIG. 23.

As assembly of panels 335′ including the spacer panels 354′ within each primary corrugation and the stiffeners or tie members 364 is particularly suited to form the end walls of a conventional frame-type metal building. That is, the load carrying capability of the panel assembly provides for eliminating the end sections of the building frame, thereby providing for a significant reduction in the cost of the metal building. In such an application, a top plate (not shown) extends across the top ends of the panel assembly and supports the outer end portions of the roof purlins used for the end bays of the building. While assemblies of the panel 335′ may also be used to form a roof for a frameless metal building, it has been found more desirable to form the roof with assemblies of panels 335 so that the roof panel assemblies may be joined with the wall panel assemblies of panels 335 at the eaves as described above in connection with FIG. 25.

Figure 29:
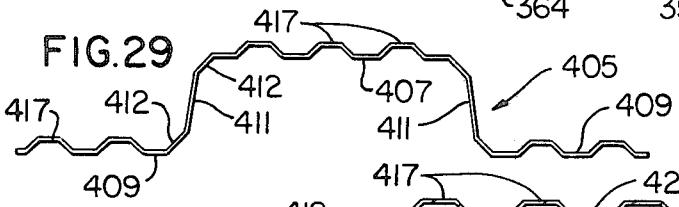
FIG. 29 is an end view of a sheet metal panel constructed in accordance with another modification of the invention.
Figure 30:
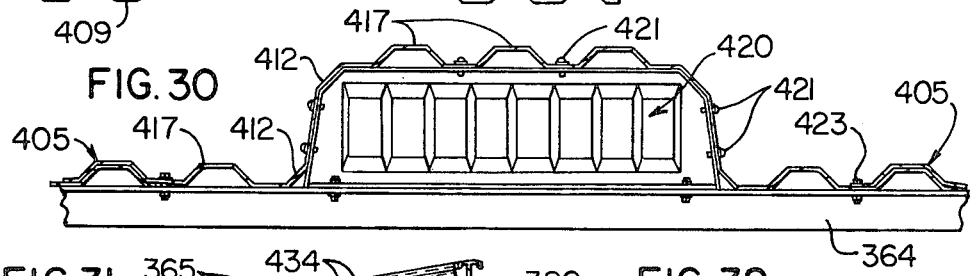
FIG. 30 is a section of a panel assembly similar to FIG. 28 and using the panel shown in FIG. 29.

Referring to FIGS. 29 and 30, a panel 405 is roll formed of light gauge sheet metal, such as 26 gauge, to form a substantially flat outer skin portion 407 which is integrally connected to generally flat and coplanar inner skin portions 409 by flat web portions 411 and beveled corner portions 112. The corner portions 412 cooperate with the web portions 411 and outer skin portion 407 to provide the panel with a single major or primary corrugation. The outer skin portion 407 is provided with two secondary corrugations 417, and each inner skin portion 409 is preferably provided with two secondary corrugations 417. The side wall or web portions 411 are slightly tapered, preferably at an angle of about ten degrees with a plane perpendicular to the inner and outer skin portions.

When the panels 405 are assembled to adjacent panels 405, as shown in FIG. 30, each of the major corrugations 415 receives a plurality of longitudinally spaced sheet metal spacer members or panels 420 which are secured to the panel 405 by threaded fasteners 421 and are constructed similar to the spacer panels 354 and 354′. The assembly of panels 405 also receives longitudinally spaced stiffeners or tie members 364 which are secured to the inner skin portions and to the adjacent spacer panel 420 by threaded fasteners 423. An assembly of panels 405, as shown in FIG. 30, is particularly suited for forming the side walls of a frame-type metal building and provides for eliminating the wall girts which are commonly constructed of heavier gauge steel. As a result, the wall panel assemblies forming the side wall of the building provide for a significant reduction in the construction cost of the building and are compatible in appearance to an assembly of panels 335′ forming each end wall of the building.

Figure 31:
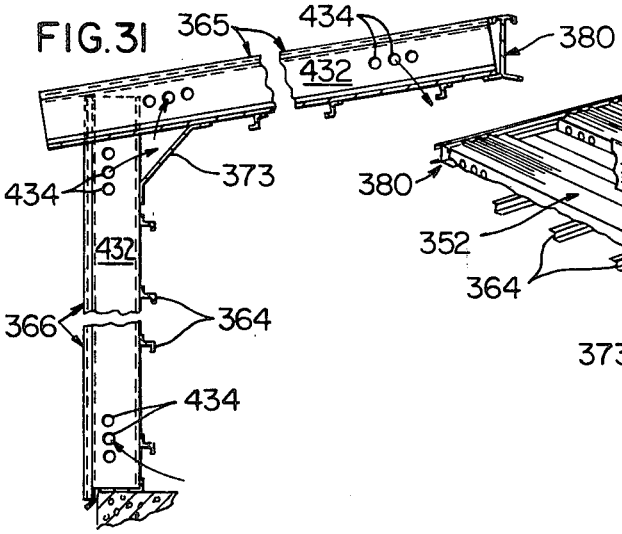
FIGS. 31 and 32 are diagrammatic illustrations of a frameless metal building constructed in accordance with the invention and incorporating a solar heating system also in accordance with the invention.
Figure 32:
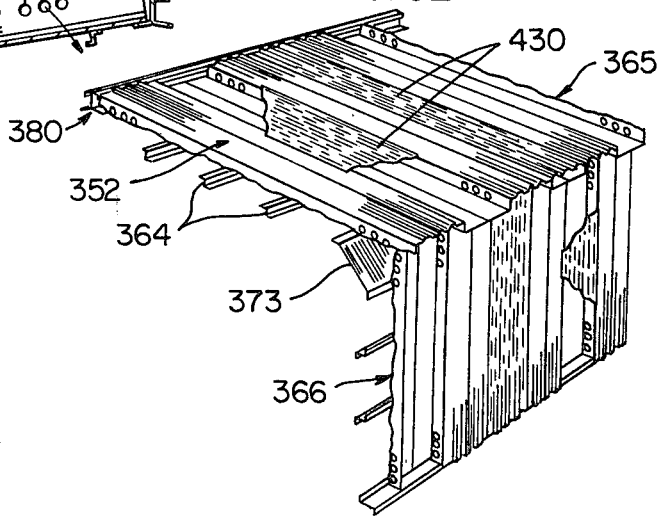

A diagrammatic assembly of panels 335 is illustrated in FIGS. 31 and 32 and form a roof panel assembly 365 and a side wall panel 366. However, in this modification, the channels defined between the primary corrugations 352 are covered with light transmitting plastic panels 430 which are preferably molded with minor corrugations. The panels 430 cooperate with the inner skin portions 339 to define airflow channels 432 between the primary corrugations. The web portions 341 of the panels 335 are provided with apertures or holes 434 in opposite end portions of the web portions.

The light transmitting panels 430 provide for solar heating of air within the passages 432, and the holes 434 provide for a natural convection flow of air up the passages 432 within the side wall panels, through the chamber defined above the brace panels 373, as the air is heated, and then upwardly through the passages 432 within the roof panel assembly with the warmer air flowing into the building adjacent the ridge beam 380. While the channels between all of the major corrugations 352 could be used for solar heating by natural air currents, only a few of the channels may be used on either the wall or roof panel assemblies or on both assemblies as shown in FIG. 32.

Figure 33:
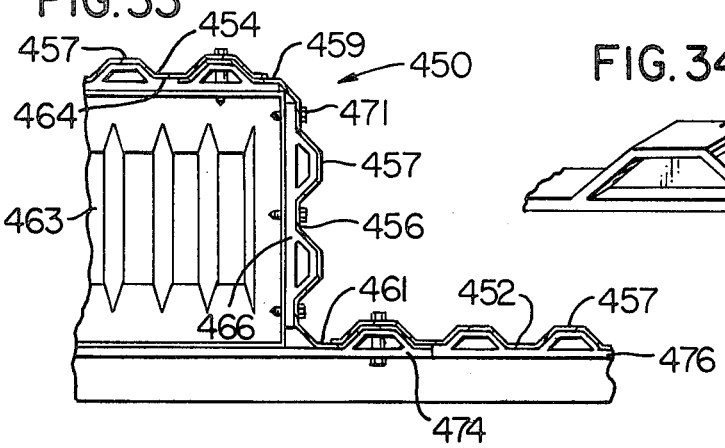
FIG. 33 is a fragmentary section of a modified panel assembly incorporating molded plastic spacer strips.

Referring to FIG. 33, a panel assembly 450 is constructed similarly to the panel assembly illustrated in FIG. 23, but includes an inner skin portion 452, an outer skin portion 454 and web portions 456 each of which is formed from a separate sheet metal panel of relatively thin gage, such as 26 gage steel. The panels forming each inner skin portion 452 and each outer skin portion 454 is generally flat with longitudinally extending secondary corrugations forming ribs 457. The separate panel forming each web portion 456 has generally a Z-shaped cross-sectional configuration and includes an outer skin portion 459 having a single rib 457 which is overlapped by an edge portion of the panel forming the outer skin portion 454. The panel forming the web portion 456 also includes an inner skin portion 461 which has a single rib 457 overlapped by an edge portion of the panel forming the inner skin portion 452.

Figure 34:
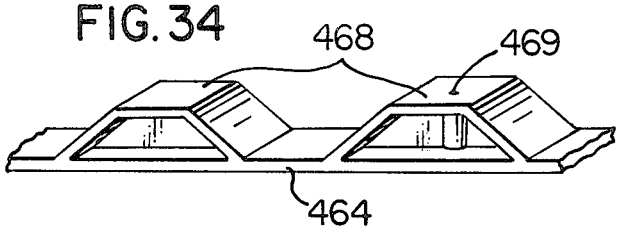
FIG. 34 is a fragmentary perspective view of a spacer strip used in the modification shown in FIG. 33.

Each major corrugation of the panel assembly 450 has a series of longitudinally spaced sheet metal spacer panels or members 463 each of which is spaced from the outer skin portion 454 and web portions 456 by corresponding spacer strips 464 and 466. As shown in FIG. 34, each of the spacer strips is molded of a rigid plastics material and includes longitudinally spaced trapezoid shaped protrusions 468 which project into the secondary corrugations forming the ribs 457 to stabilize the ribs and prevent distortion when the panel assembly is stressed. The spacer strips 464 and 466 also provide thermal barriers to the transfer of heat and are provided with holes 469 through which threaded fasteners 471 extend to secure the outer skin and web portions to the adjacent spacer panel 463.

As also shown in FIG. 33, the spacer panels 463 and the inner skin portions 452 of the web assembly 450 are fastened to laterally extending stiffners or tie members by fasteners which also extend through molded plastic spacer strips 474 and 476. As understood from the description of panel assemblies referred to above, the panel assembly 450 may be used for the construction of each side wall, each end wall and the roof of a rectangular frameless metal building, or the panel assembly 450 may be used for the construction of only the end walls and/or side walls of a partial frame-type metal building when it is desired to eliminate some of the frame members.

Figure 35:
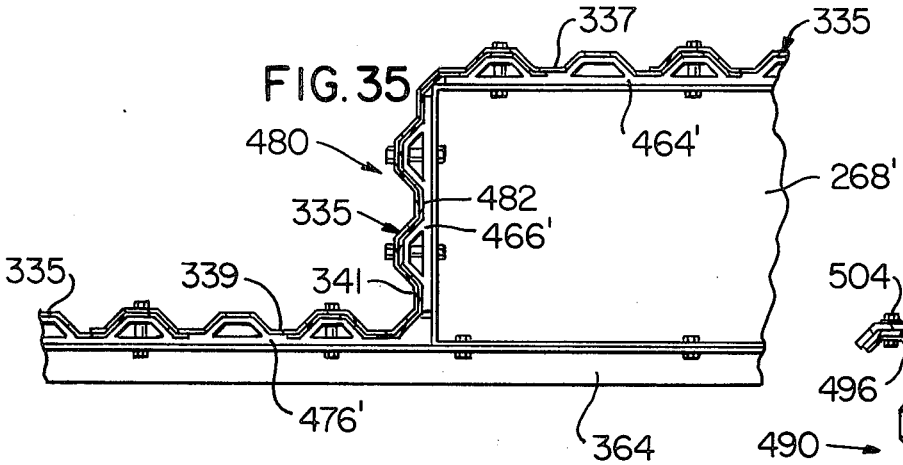
FIG. 35 is a fragmentary section of a modified panel assembly incorporating inner reinforcing or stiffening panels.

FIG. 35 illustrates a panel assembly 480 which is similar to the panel assembly described above in connection with FIG. 23 and which includes Z-shaped panels 335 each having an outer skin portion 337, an inner skin portion 339 and a web portion 341. The skin and web portions are spaced from the tie members 364 and spacer members or panels 268' by plastic spacer strips 464', 466' and 476', in a manner as described above in connection with FIG. 33. In addition, the panel assembly 480 includes a web reinforcing member or panel 482 which also has a Z-shaped cross-sectional configuration and underlies each panel 335 for a predetermined portion of its length. The web reinforcing panels 482 provide the panel assembly 480 with extra strength in areas where there is a high shear lag. Thus in the construction of a frameless metal building, the web reinforcing panels 482 are adapted for use on each major corrugation of the roof panel assembly and each side wall panel assembly in the interconnecting eave portions, for example, as shown in FIG. 25. The length of each web reinforcing panel 482 is on the order of five feet to six feet and the panels are located in the upper portion of the side wall panel assembly and the outer eave portion of the roof panel assembly.

Figure 36:
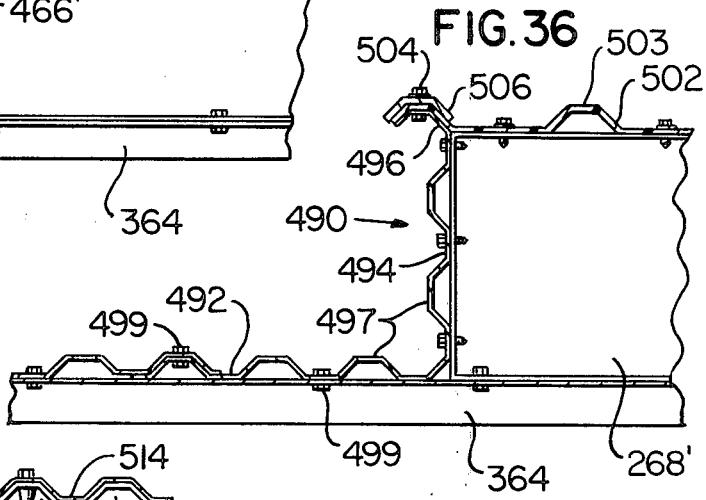
FIG. 36 is a fragmentary section of a modifed panel assembly incorporating light transmitting panels for forming a skylight or wall lights.

In the modification shown in FIG. 36, a panel assembly 490 includes generally C-shaped panels each of which includes an inner skin portion 492 integrally connected to a web portion 494 which extends to form a return outer edge or flange portion 496. Each of the portions 492 and 494 have longitudinally extending and parallel spaced minor corrugations forming ribs 497, and the outer flange portion 496 is also bent or formed in a trapezoid-shaped rib. A series of fasteners 499 secure adjacent overlapping inner skin portions 492 to each other and to the stiffners or tie members 364, and similar fasteners connect each web portion 494 to the adjacent spacer panel or member 268'.

The outer skin portion of one or more primary corrugations of the panel assembly 490 is formed by a generally flat panel 502 of light transmitting plastics material such as fiberglass and having longitudinally extending parallel spaced ribs 503. Each plastic panel 502 is secured by fasteners to the longitudinally spaced spacer members 268', and the opposite edge portions of the panel 502 are secured by fasteners 504 to the underlying flange portion 496. As also shown in FIG. 36, an elongated reinforcing strip 506 is secured to each outer flange portion 496 by the fasteners 504, and the strips 506 for each primary corrugation are formed of heavier gage steel to reinforce the primary corrugation in the same manner as the reinforcing panels 482 (FIG. 35) and thereby remove stress from the plastic panels 502. It is apparent that a panel 502 may be used in a wall panel assembly wherever a window or side light is desired and may be used in a roof assembly wherever a skylight is desired. Additional strips 506 may be desirable in the upper portions of a wall panel assembly and in the outer or eave portions of a roof panel assembly of a frameless metal building.

Figure 37:
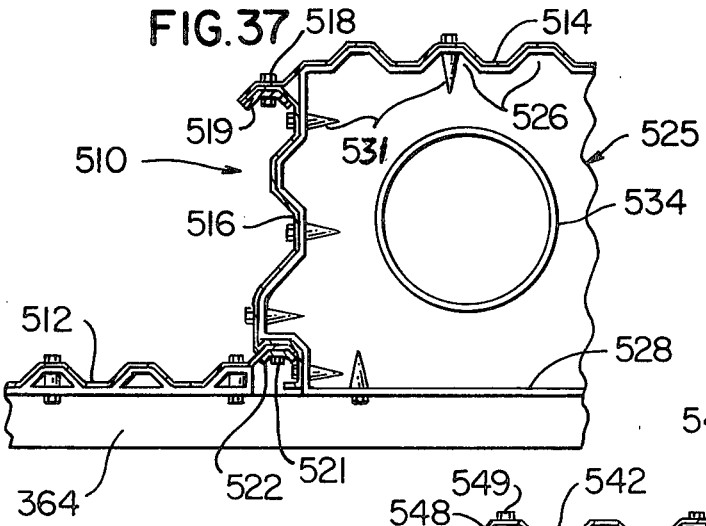
FIGS. 37 and 38 are fragmentary sections of modified panel assemblies incorporating molded plastic spacer members.

Another modified panel assembly 510 is illustrated in FIG. 37 and may also be used for forming a wall and/or roof for a metal building. The panel assembly 510 includes a generally flat panel forming an inner skin portion 512, and another generally flat panel forms the outer skin portion 514 of each primary corrugation. The inner and outer skin portions are rigidly connected by separate reverse Z-shaped panels which form the web portions 516 for each primary corrugation. Each web panel or portion 516 has an outer flange which is secured to an overlapping edge portion of the outer skin panel or portion 514 by longitudinally spaced fasteners 518 which also extend through an underlying reinforcing strip 519 formed similarly to a reinforcing strip 506, that is, of substantially heavier gage steel. Each web panel or portion 516 also has an inner flange which overlaps an edge portion of the inner skin panel or portion 512 and is secured by fasteners 521 which extend through an inner reinforcing strip 522. Depending upon the strength required from the panel assembly 510. The gage of each web panel or portion 516 may be heavier than the gage of the sheet metal used to roll-form each inner skin panel or portion 512 and each outer skin panel or portion 514, according to the loading on the panel assembly. The use of the outer and inner reinforcing strips 519 and 522 is also dependent upon the strength required from the skin portions of the major corrugations and makes optimum use of the sheet metal forming the skin and web portions. One or more of the inner skin portions 512 of the panel assembly 510 may be formed of a light transmitting material.

As also shown in FIG. 37, each of the primary corrugations of the panel assembly 510 receives a plurality of longitudinally spaced spacer members 525 each of which is injection molded of a thermoplastics material. Each of the spacer members 525 includes peripherally spaced projections 526 which extend into the minor or secondary corrugations forming the ribs on the outer skin portion 514 and on the web portions 516, and the projections 526 function to stabilize the ribs and maintain the predetermined corrugated cross-sectional configuration of each panel portion. A reinforcing rib 528 extends around the periphery of each plastic member 525, and peripherally spaced molded bosses 531 define holes for receiving self-threading fasteners which extends through the outer skin portion, web portions and the tie members 364. A pair of holes 534 are formed in each of the spacer members 525 to reduce the amount of plastics material required to mold the spacer member, and the holes may have any desired configuration. It is also apparent that the spacer members 525 function as a thermal barrier to minimize the transfer of heat, and the bosses 531 for the outer skin panel or portion 514 are located within the ribs instead of in the valleys between the ribs, which is particularly desirable to avoid water leaks when the panel assembly 510 is used to form a roof.

Figure 38:
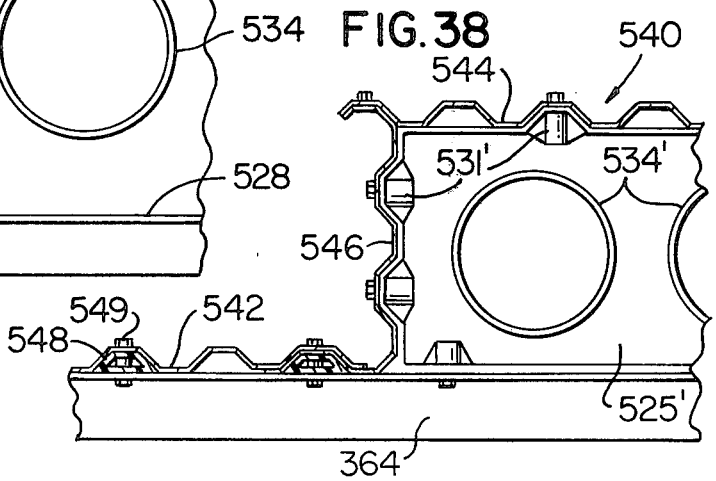
Figure 44:
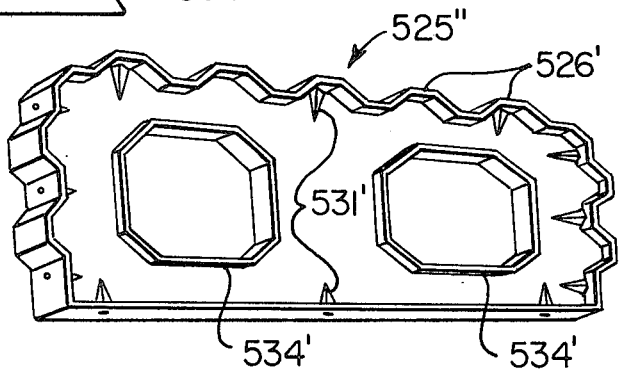
FIG. 44 is a perspective view of a molded plastic spacer member adapted for use in the panel assembly shown in FIG. 23.

A modified panel assembly 540 is illustrated in FIG. 38 and includes generally flat sheet metal panels forming each inner skin portion 542 and each outer skin portion 544. The inner and outer skin portions are rigidly connected by separate panels forming web portions 546 each of which has a generally C-shaped cross-sectional configuration, similar to the separate panel forming each web portion 494 in the modification shown in FIG. 36. A plurality of molded plastic spacer members 525' are longitudinally spaced within each primary corrugation of the panel assembly 540, and each spacer panel 525' is constructed similarly to the spacer panel 525 discussed above. Another example of a plastic molded spacer member 525'' is illustrated in FIG. 44 and has peripherally spaced trapezoid projections 526', bosses 531' and a pair of octagonal-shaped holes 534'. The panel assembly 540 shown in FIG. 38 also includes individual molded plastic rib spacers 548 which are used to stabilize the ribs or secondary corrugations on the inner skin panel or portion 542 and to provide for locating the threaded fasteners 549 within the ribs instead of within the valleys defined between the ribs.

As mentioned above, panel assemblies constructed in accordance with the invention may be used for forming the end walls and/or side walls of a frame-type metal building and will provide for a significant reduction in the cost of constructing the building. Thus referring to FIGS. 39–41, a clear-span frame-type metal building incorporates one or more arch-shape frame members 565 which extend across the width of the building and support parallel spaced and longitudinally extending frame members or purlins 567 each of which usually has a Z-shaped cross-sectional configuration. A set of C-shaped eave purlins 568 (FIG. 41) extend along the eaves of the building and are supported by plates 569 welded to the frame members 565.

Figure 39:
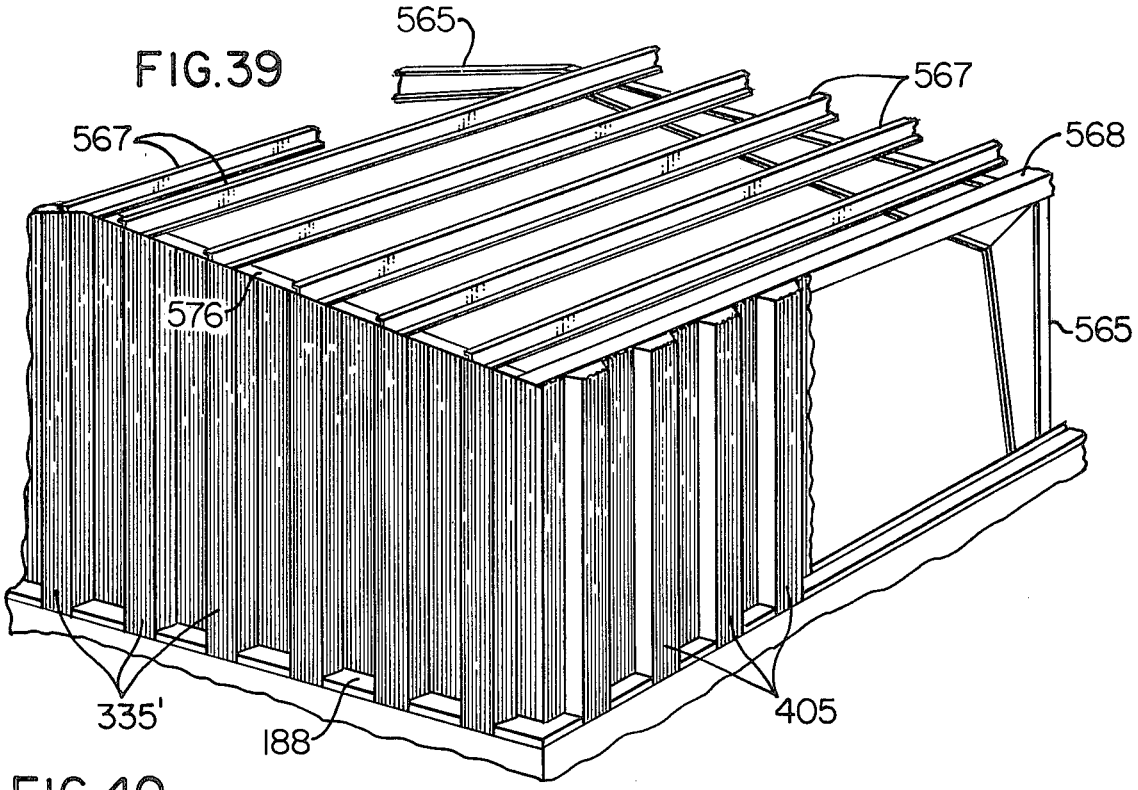
FIG. 39 is a fragmentary perspective view of a frame-type metal building incorporating panel assemblies in accordance with the invention.

In a conventional manner, the purlins 567 and 568 support generally flat sheet metal roof panels 570 (FIG. 40) which have longitudinally extending corrugations forming parallel spaced ribs 572 extending from the center ridge of the metal building to the opposite eaves of the building. The roof panels have overlapping edge portions and are secured to the purlins by conventional threaded fasteners (not shown). As illustrated in FIG. 39, the end walls of the metal building are formed by an assembly of panels 335' described above in connection with FIG. 28. The side walls of the building are each formed by an assembly of panels 405, as described above in connection with FIGS. 29 and 30. However, it is within the scope of the invention to use other panel assemblies disclosed in this application for forming the end walls and side walls of the partial frame-type building shown in FIG. 39.

Figure 40:
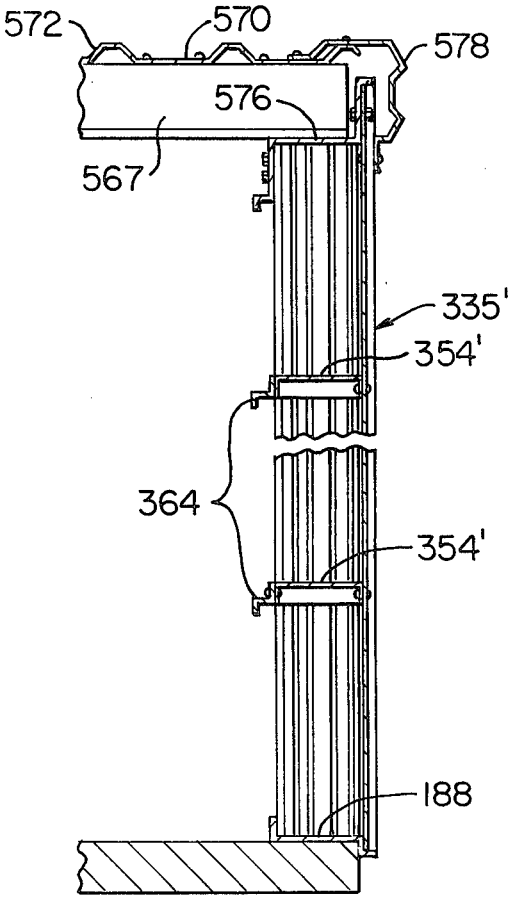
FIG. 40 is a vertical section through an end wall of the building shown in FIG. 39.
Figure 41:
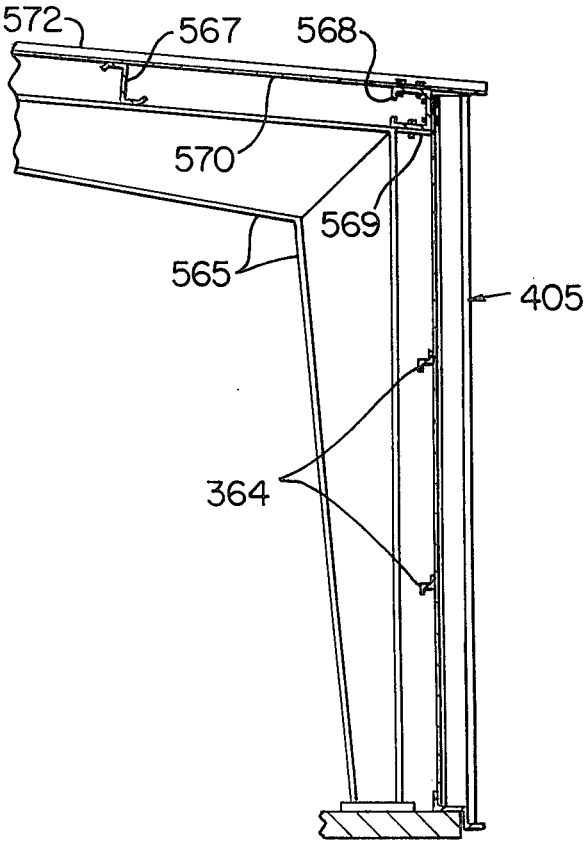
FIG. 41 is a vertical section through a side wall of the building shown in FIG. 39.

As shown in FIG. 40, the ends of the purlins 567 and 568 which are used within the opposite end bays of the building illustrated in FIG. 39, are supported by a corresponding formed metal top plates 576 each of which has a Z-shaped cross-sectional configuration and mounts on the top ends of the assembled panels 335'. An elongated sheet metal corner panel 578, having generally a C-shaped cross-sectional configuration, covers the upper ends of the end wall panel assembly and is secured to the purlins 567 and to wall panel assembly. By using wall panel assemblies constructed in accordance with the invention to form the end walls of the metal building shown in FIGS. 39 and 40, the end frame members 565 are eliminated, thereby significantly reducing the cost of the steel used for constructing the building. In addition, by using panel assemblies, such as an assembly of the panels 405, to form the side walls of the building shown in FIGS. 39 and 41, the conventional horizontally extending wall beams or girts are eliminated, which also contributes to a significant reduction in the cost of constructing the metal building.

Figure 42:
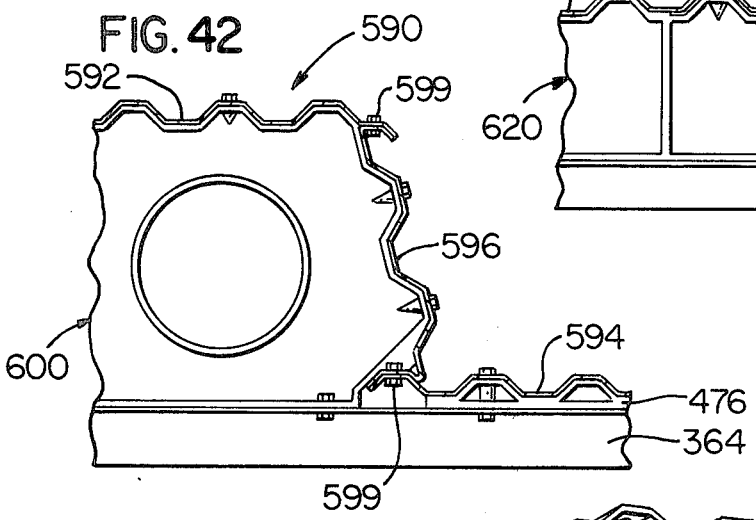
FIGS. 42 and 43 are fragmentary sections of modified panel assemblies incorporating plastic spacer members and strips.

A modification of the panel assembly 510 shown in FIG. 37, is illustrated in FIG. 42. In this embodiment, a panel assembly 590 is particularly suited for use in forming the end walls and/or the side walls of a metal building having a conventional roof assembly, as discussed above in connection with FIGS. 39–41. The panel assembly 590 includes generally flat outer skin panels or portions 592 and generally flat inner skin panels or portions 594, both of which provide for compact nesting of a plurality of the panels in a stack. The inner and outer skin portions are rigidly connected by separate web panels or portions 596 each having a generally reverse Z-shaped cross-sectional configuration with bent edge portions forming flanges secured to the inner and outer skin portions by fasteners 599.

A plastic spacer strip 476 separates each inner skin panel or portion 594 from each tie member 364, and a plurality of molded plastic spacer members 600 are arranged at longitudinally spaced intervals within each of the primary corrugations formed by each pair of web portions 596 and outer skin portion 592. The primary difference between the panel assembly 590 and the panel assembly 510 (FIG. 37) is that each separate web panel or portion 596 is positioned at a small acute angle relative to a plane perpendicular to the inner and outer skin portions. Thus the panel assembly 590 is adapted for use in forming end and/or side walls of a partial frame-type metal building, but is not adapted for use in forming a roof panel assembly for a frameless metal building such as described above in connection with FIG. 25.

Figure 43:
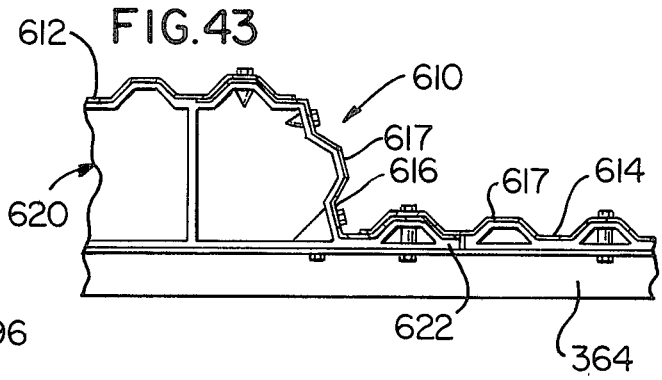

A panel assembly 610 (FIG. 43) also includes a generally flat outer skin panel or portion 612 and a generally flat inner skin panel or portion 614 which provides for compact nesting during shipping and storage. The inner and outer skin portions are rigidly connected by separate web panels or portions 616 each of which has a generally Z-shaped cross-sectional configuration and is also adapted for compact nesting of a number of panels in a stack. Each web portion 616 has a single intermediate rib 617, and each of the inner and outer skin portions of each web panel has a single rib which is overlapped by a rib on the corresponding skin panel or portion. Each of the primary corrugations of the panel assembly 610 has a plurality of longitudinally spaced spacer members 620 which are molded of a plastics material, and each spacer member includes a pair of outwardly projecting spacer strip portions 622 which permit the outer skin portion and web portions for each major corrugations to be preassembled on the ground and then erected into position followed by tie members 364 before the interconnecting inner skin panel or portion 614 is installed. The panel assembly 610 is also adapted for use in forming the end walls or side walls for a partial frame-type metal building and is not suited for use in forming a frameless metal building.

Figure 45:
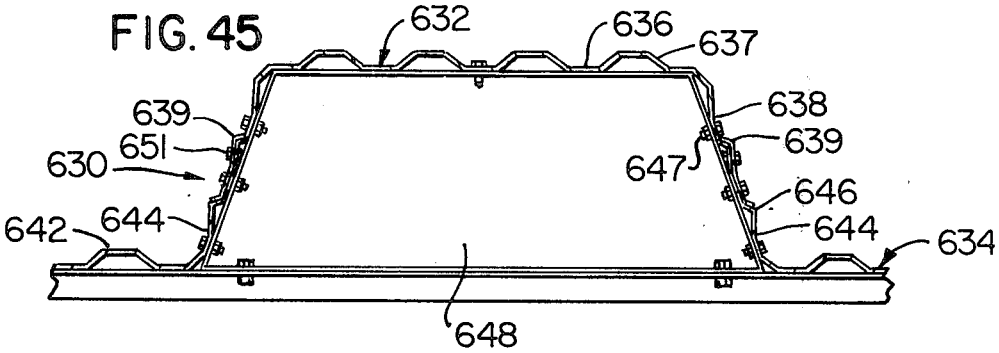
FIGS. 45 and 46 are fragmentary sections of modified panel assemblies incorporating web portions with stepped reinforcing ribs.

Another embodiment of a panel assembly 630 constructed in accordance with the invention, is illustrated in FIG. 45. The panel assembly 630 includes a series of connected sheet metal panels 632 and 634 each of which has the same generally U-shaped cross-sectional configuration. Each sheet metal panel 632 includes an outer skin portion 636 having longitudinally extending parallel spaced secondary corrugations forming ribs 637. The opposite side portions of each panel 632 are bent inwardly to form web portions 638 each of which has a step-like cross-sectional configuration forming a longitudinally extending rib 639. Each of the panels 634 is similarly constructed and forms an inner skin portion 642, and the side portions of the panels are bent to form outwardly projecting web portions 644 each of which also has a step-like cross-sectional configuration forming a rib 646. The web portion 638 and 644 are rigidly secured by fasteners 647 to trapezoid-shaped spacer panels or members 648 arranged at longitudinally spaced intervals. The web portions 638 and 644 also overlap and are connected together by longitudinally spaced fasteners 651.

As a result of the configuration of the panels 632 and 634, it is apparent that a plurality of the panels will nest closely together to form a compact stack which is highly desirable for storage and shipping. The panel assembly 630 is also adapted for use in forming end walls and/or side walls in a partial frame-type building such as shown in FIG. 39 and is not particularly suited for use in forming walls and a roof for a frameless metal building.

Figure 46:
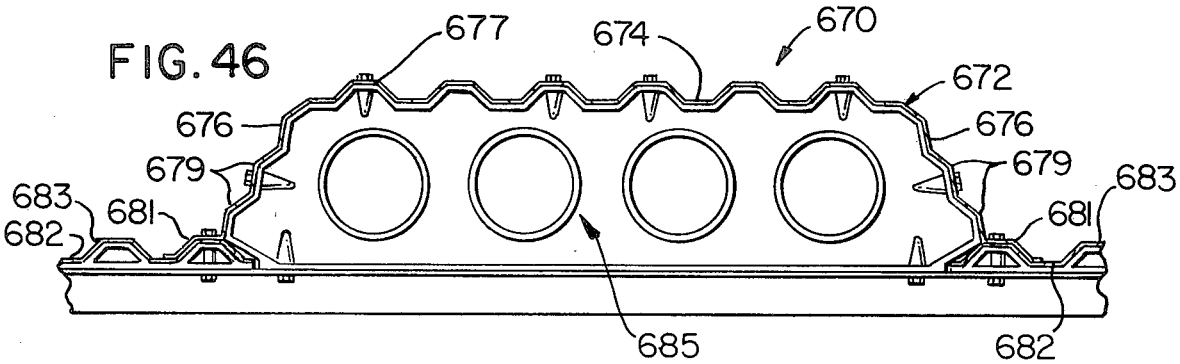

FIG. 46 illustrates another panel assembly 670 which is also constructed in accordance with the invention. In this embodiment, a sheet metal panel 672 is roll-formed to form an outer skin portion 674 and opposite web portions 676. The outer skin portion 674 has longitudinally extending ribs 677, and each web portion 676 has a step-like cross-sectional configuration forming longitudinally extending V-shape ribs 679. The outer edge portions 681 of the panel 672 are formed outwardly and overlap the adjacent inner skin panels or portions 682 each of which is generally flat with longitudinally extending ribs 683.

Each of the primary corrugations formed by a panel 672 has longitudinally spaced spacer members 685 each of which is molded of a plastics material and has an outer peripheral surface conforming to the configuration of the panel 672. The cross-sectional configuration of each panel 672 provides for close nesting of a plurality of the panels in order to form a compact stack of panels. The inner skin panels or portions 682 are also adapted for close nesting in a stack. However, in view of the tapered or inclined web portions 676 of the panel assembly 670, the panel assembly is adapted for forming an end wall and/or a side wall for a partial frame-type metal building but is not adapted for use in forming the side wall and roof of a frame-less metal building.

Figure 4:
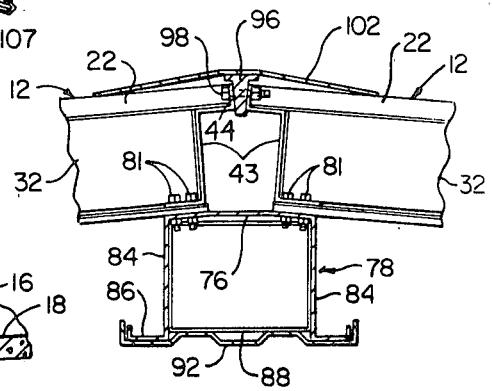
FIG. 4 is an enlarged vertical section through the ridge portion of the building shown in FIG. 1.

From the drawings and the above description, it is apparent that a metal building constructed in accordance with the present invention, provides desirable features and advantages. For example, after the roof panels and/or wall panels are assembled as described above, the assembled panels have a combined total strength substantially higher than the strength of each panel per se times the number of panels. This higher total strength of the assembled panels results primarily from the transmission of a concentrated load in one panel or group of panels to the laterally adjacent and/or opposing panels through the panel connecting means such as the longitudinally extending ridge beam and eve attachments. Furthermore, the coupling of the roof panels across the ridge by means as shown in FIG. 4, or FIG. 12 or FIG. 26, provides for utilizing the high tensile strength of the inner sheet metal roof skins or skin portions and the high compression strength of the outer roof skins or skin portions for carrying the loads.

Another important feature of a building constructed in accordance with the invention is provided by the coupling of the roof panels to the wall panels as shown in FIG. 5 or FIG. 10 or FIG. 25. These attachment means function to transfer the stress or loads from the roof panels to the wall panels and to utilize the inner and outer skin portions of the wall panels to resist bending of the roof panels. Thus the construction and assembly of the roof and wall panels effectively utilize the inherent strength of the sheet metal skin portions of the panels and thereby eliminate the need for a frame and its cost of erection along with the need for roof purlins and wall girts.

Since the sheet metal used for forming the components of the roof panels and wall panels are of substantially lighter gauge, such as 26 gauge, than are commonly used for forming roof purlins and wall girts for a conventional metal building of the same size, the total weight of a frameless metal building constructed in accordance with the invention is significantly lower than the total weight of a conventional metal building of the same size. As a result, the cost of metal used in constructing a building of the invention is significantly lower than the cost of the metal used in a conventional metal building. The relatively light weight of the roof panels and wall panels, for example, less than 160 pounds for any panel of a building having a width of 60 feet, also provides for a simple and quick erection of the building without the need of a crane.

The prefabrication of the roof panels and wall panels also permits quick assembly of the panels, beginning at one end of the building and progressing towards the opposite end. The precise placement of the prepunched holes in the panels and in the ridge and eave members assures positive location of the panels and permits erection of the building by labor less skilled than the labor normally required for conventional metal buildings. It is also apparent that the roof panels 12 and wall panels 14 may enclose a thermal insulation material when desired.

With respect to the "single skin" metal panels and building disclosed in connection with FIGS. 9–46, the longitudinally spaced spacer members or panels within the primary corrugations and the continuous horizontal tie members cooperate with the primary corrugations and with the secondary corrugations to provide the assembled panels with a maximum strength/weight ratio. In addition, the Z-shaped panels disclosed in connection with FIGS. 16–28, 33 and 43, have several advantages for constructing either a "single skin" or a "double skin" metal building. For example not only may the elongated Z-shaped panels be roll-formed from a common gauge sheet metal such as 26 gauge steel, the Z-shaped panels may be stacked in a compact nesting manner to facilitate storage and shipping. The flexibility of the Z-shaped panel also permits constructions of either a "single skin" metal building or a "double skin" metal building and permits the web portion of each Z-shaped panel to be formed with the desired depth according to the size of the metal building.

By reversing the Z-shaped panels end-for-end, the panels may have a prefinished outer surface such as a baked-on enamel coating. Furthermore, the width of the inner skin portion of each Z-shaped panel may be conveniently made slightly wider than the outer skin portion of the panel so that the roof panels will easily interfit between the side wall panels, as shown in FIG. 25, during erection of the building. As mentioned above in connection with FIG. 17, a metal building constructed with Z-shaped panels may also be provided with higher strength and a generally flush outer surface by simply adding a flat outer skin panel 238 between each pair of adjacent primary corrugations. Similarly, generally flat inner skin panels 246 may be added to provide the roof and/or wall panel assembly with a "double skin" construction and to provide a generally flat inner surface for the panel assemblies.

With respect to FIG. 25, it is also within the scope of the invention to stagger the primary corrugations of the roof panels with respect to the primary corrugations of the wall panels so that the inner skin portions 339 of the wall panels are connected to the outer skin portions 337 of the roof panels, and vice versa, by inclined brace members or panels 372 which interfit between the primary corrugations and extend between the inner skin portions of the wall panels and the outer skin portions of the roof panels and vice versa, providing the appearance of a continuous brace panel.

As mentioned above, the panel assemblies of the invention also provide advantages when used to form the end walls and/or side walls of a partial frame-type metal building. The panel assemblies illustrated in FIGS. 28, 30, 42, 43, 45 and 46 are particularly suited for forming such walls, however, other disclosed panel assemblies may also be used. In reference to the panel assemblies illustrated in FIGS. 33, 37, 38, 42 and 43, the separate panels which form the web portions may be roll-formed of a slightly heavier gage sheet metal, thereby providing for producing panel assemblies which span greater lengths and/or carries heavier loads. In addition, the molded plastic spacer members and strips provide not only for simplified fastening of the skin and web portions with self-threading screws but also for stabilizing the ribs, producing a thermal barrier and for locating the fasteners within the ribs instead of the valleys.

While the forms of building panels and structures and their methods of construction and assembly herein described constitute preferred embodiments of the invention, it is to be understood that the invention is not limited to these precise forms, and that changes may be made therein without departing from the scope and spirit of the invention as defined in the appended claims. As mentioned above, it is also within the scope of the invention to use panel assemblies constructed in accordance with the invention as parts of conventional frame-type metal buildings, for example, as end walls or side walls or roof sections in order to provide a cost savings.

The invention having thus been described, the following is claimed:

1. A panel assembly adapted to form a generally flat load bearing frameless wall for a metal building, comprising a series of elongated thin sheet metal panels forming generally flat elongated inner skin portions and generally flat elongated outer skin portions with generally flat elongated web portions extending between said inner and outer skin portions, fastener means connecting said panels with said outer skin portions and said web portions forming parallel spaced and longitudinally extending primary corrugations each having a U-shaped cross-sectional configuration, said inner and outer skin portions having longitudinally extending and parallel spaced secondary corrugations forming ribs substantially smaller than said primary corrugations, a plurality of spacer members disposed within said primary corrugations and secured to said web portions, at least one of said spacer members including a spacer of molded plastics material and having a corrugated outer flange portion projecting into said secondary corrugations within the adjacent said outer skin portion to stabilize said ribs, each said web portion being formed by a sheet metal panel separate from said sheet metal panels forming the adjacent said inner and outer skin portions and having at least one longitudinally extending secondary corrugation forming a rib, said sheet metal panel forming each said web portion having bent inner and outer longitudinal U-shaped edge portions defining corresponding longitudinally extending said ribs, and said sheet metal panels forming said generally flat inner and outer skin portions having bent opposite longitudinal U-shaped edge portions forming corresponding said ribs overlapping the adjacent ribs of said web portions.

2. A panel assembly as defined in claim 1 wherein said longitudinal edge portions of each said panel forming one of said web portions project in opposite directions to provide said web portion with a generally Z-shape cross-sectional configuration.

3. A panel assembly as defined in claim 1 wherein said longitudinal edge portions of each said panel forming one of said web portions project in the same direction to provide said web portion with a generally C-shape cross-sectional configuration.

4. A panel assembly as defined in claim 1 wherein said outer longitudinal edge portion adjacent said outer skin portion projects outwardly from the corresponding said primary corrugation.

5. A panel assembly as defined in claim 1 wherein said inner longitudinal edge portion adjacent said inner skin portion projects inwardly into the corresponding said primary corrugation.

6. A panel assembly as defined in claim 1 wherein said panel forming each said web portion has a plurality of parallel spaced and longitudinally extending said secondary corrugations forming parallel space ribs.

7. A panel assembly as defined in claim 1 and including an elongated formed metal strip extending in conforming relation adjacent one of said longitudinal edge portions of at least one of said panels forming one of said web portions, said strip having a thickness greater than the thickness of said panel, and a series of longitudinally spaced fasteners securing said strip to said edge portion.

8. A panel assembly as defined in claim 1 and including an elongated generally flat panel of light-transmitting plastics material forming a skin portion of said panel assembly.

9. A panel assembly as defined in claim 1 wherein said plastics material of said spacer defines holes for receiving threaded fasteners extending through said outer skin portion and said web portions defining the corresponding said primary corrugation.

10. A panel assembly adapted to form a generally flat load bearing frameless wall and/or roof for a metal building, comprising a series of elongated sheet metal panels forming generally flat elongated inner skin portions and generally flat elongated outer skin portions with generally flat elongated web portions extending between said inner and outer skin portions, fastener means connecting said panels with said outer skin portions and said web portions forming parallel spaced and longitudinally extending primary corrugations each having a U-shaped cross-sectional configuration, said inner and outer skin portions having longitudinally extending and parallel spaced secondary corrugations forming ribs substantially smaller than said primary corrugations, said web portions having longitudinally extending and parallel secondary corrugations forming ribs substantially smaller than said primary corrugations, a plurality of spacer members disposed within said primary corrugations and connected to said web portions, each said spacer member including a body of molded plastics material, and said body of each said spacer member including an integrally molded corrugated outer flange portion projecting into said secondary corrugations within the adjacent said web portions and outer skin portion to prevent bowing and distortion of the major corrugations and to stabilize said ribs.

11. A panel assembly as defined in claim 10 wherein said plastics material of each said spacer member defines holes for receiving self-threading fasteners extending through said outer skin portion and said web portions defining the corresponding said primary corrugation.

12. A panel assembly as defined in claim 11 wherein said spacer has generally a rectangular configuration.

13. A panel assembly as defined in claim 11 wherein said spacer has generally a trapezoid configuration.

14. A panel assembly as defined in claim 10 and including a series of elongated tie members disposed at longitudinally spaced intervals along the connected said panels and extending laterally across said primary corrugations and said secondary corrugations of said inner skin portions, and fastener means securing each said tie member to said inner skin portions.

15. A panel assembly as defined in claim 10 wherein each said inner skin portion and adjacent web portions are integrally connected and are formed from a single said panel, each said web portion having a step-like corrugated cross-sectional configuration forming at least one longitudinally extending rib, said web portions extending from each said inner skin portion being continuously diverging and overlapping said web portions extending from the adjacent said outer skin portions, and fastener means securing said overlapping web portions.

16. A panel assembly as defined in claim 10 wherein each said inner said skin portion comprises a single generally flat said panel and has opposite edge portions overlapping the adjacent said web portions.

* * * * *